US010712679B1

(12) United States Patent
Kajiwara et al.

(10) Patent No.: US 10,712,679 B1
(45) Date of Patent: Jul. 14, 2020

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventors: Kenji Kajiwara, Kanagawa (JP); Wataru Yamada, Kanagawa (JP); Masahiro Iwasaki, Kanagawa (JP); Kota Maki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/514,314

(22) Filed: Jul. 17, 2019

(30) Foreign Application Priority Data

Mar. 20, 2019 (JP) ..... 2019-052415

(51) Int. Cl.
*G03G 5/14* (2006.01)
*G03G 15/00* (2006.01)
*G03G 21/18* (2006.01)

(52) U.S. Cl.
CPC ..... *G03G 5/144* (2013.01); *G03G 15/75* (2013.01); *G03G 21/1803* (2013.01)

(58) Field of Classification Search
CPC ..... G03G 5/142
See application file for complete search history.

(56) References Cited

U.S. PATENT DOCUMENTS 4,579,801 A * 4/1986 Yashiki ..... G03G 5/144 430/60
8,632,931 B2 1/2014 Sekido et al.
2014/0377701 A1* 12/2014 Okuda ..... G03G 5/14 430/130

FOREIGN PATENT DOCUMENTS

JP 2008-310307 A 12/2008
JP 2009-288621 A 12/2009
JP 2011-095665 A 5/2011

* cited by examiner

*Primary Examiner* — Peter L Vajda
(74) *Attorney, Agent, or Firm* — Sughrue Mion, PLLC

(57) ABSTRACT

An electrophotographic photoreceptor includes a conductive substrate; an undercoat layer on the conductive substrate, the undercoat layer containing at least one perinone compound selected from the group consisting of a compound represented by general formula (1) and a compound represented by general formula (2) below, metal oxide particles of at least one type selected from the group consisting of aluminum oxide particles, iron oxide particles, copper oxide particles, magnesium oxide particles, calcium oxide particles, and silicon dioxide particles, and a binder resin, the undercoat layer having a thickness of 1 μm or more and 10 μm or less; and a photosensitive layer on the undercoat layer.

(Continued)

general formula (1)

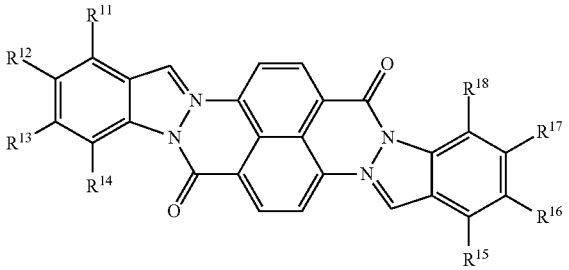

general formula (2)

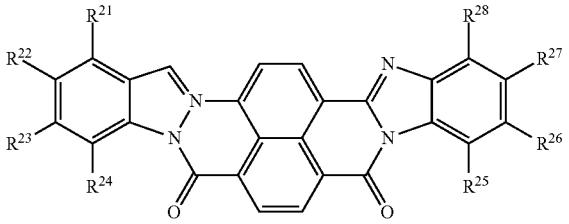

In general formula (1), $R^{11}$, $R^{12}$, $R^{13}$, $R^{14}$, $R^{15}$, $R^{16}$, $R^{17}$, and $R^{18}$ each independently represent a hydrogen atom, an alkyl group, an alkoxy group, an aralkyl group, an aryl group, an aryloxy group, an alkoxycarbonyl group, an aryloxycarbonyl group, an alkoxycarbonylalkyl group, an aryloxycarbonylalkyl group, or a halogen atom; $R^{11}$ and $R^{12}$ may be bonded to each other to form a ring, so may $R^{12}$ and $R^{13}$, and so may $R^{13}$ and $R^{14}$; and $R^{15}$ and $R^{16}$ may be bonded to each other to form a ring, so may $R^{16}$ and $R^{17}$, and so may $R^{17}$ and $R^{18}$. In general formula (2), $R^{21}$, $R^{22}$, $R^{23}$, $R^{24}$, $R^{25}$, $R^{26}$, $R^{27}$, and $R^{28}$ each independently represent a hydrogen atom, an alkyl group, an alkoxy group, an aralkyl group, an aryl group, an aryloxy group, an alkoxycarbonyl group, an aryloxycarbonyl group, an alkoxycarbonylalkyl group, an aryloxycarbonylalkyl group, or a halogen atom; $R^{21}$ and $R^{22}$ may be bonded to each other to form a ring, so may $R^{22}$ and $R^{23}$, and so may $R^{22}$ and $R^{24}$; and $R^{25}$ and $R^{26}$ may be bonded to each other to form a ring, so may $R^{26}$ and $R^{27}$, and so may $R^{27}$ and $R^{28}$.

13 Claims, 2 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2019-052415 filed Mar. 20, 2019.

BACKGROUND

(i) Technical Field

The present disclosure relates to an electrophotographic photoreceptor, a process cartridge, and an image forming apparatus.

(ii) Related Art

Japanese Unexamined Patent Application Publication No. 2011-095665 discloses an electrophotographic photoreceptor including a conductive support, and an intermediate layer and a photosensitive layer disposed on the conductive support in that order, in which the intermediate layer contains a polyolefin resin and a benzimidazole-based compound.

Japanese Unexamined Patent Application Publication No. 2009-288621 discloses an electrophotographic photoreceptor including a conductive support, and an undercoat layer and a photosensitive layer disposed on the conductive support in that order, in which the undercoat layer contains a benzimidazole-based compound and an olefin resin that contains, as a constituent component, a compound having at least one of a carboxylic acid group and a carboxylic anhydride group.

Japanese Unexamined Patent Application Publication No. 2008-310307 discloses an electrophotographic photoreceptor that includes an undercoat layer containing metal oxide particles.

SUMMARY

Aspects of non-limiting embodiments of the present disclosure relate to an electrophotographic photoreceptor that has excellent charge-retaining property, suppresses occurrence of leakage current caused by being pierced with foreign matter, and suppresses an increase in residual potential that occurs by repeated image formation compared to an electrophotographic photoreceptor that includes an undercoat layer that contains a perinone compound and zinc oxide particles, titanium oxide particles, or tin oxide particles but not aluminum oxide particles, iron oxide particles, copper oxide particles magnesium oxide particles, calcium oxide particles, or silicon dioxide particles or compared to an electrophotographic photoreceptor that includes an undercoat layer that contains a perinone compound and aluminum oxide particles and has a thickness of more than 10 μm.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an electrophotographic photoreceptor including a conductive substrate; an undercoat layer on the conductive substrate, the undercoat layer containing at least one perinone compound selected from the group consisting of a compound represented by general formula (1) and a compound represented by general formula (2) below, metal oxide particles of at least one type selected from the group consisting of aluminum oxide particles, iron oxide particles, copper oxide particles, magnesium oxide particles, calcium oxide particles, and silicon dioxide particles, and a binder resin, the undercoat layer having a thickness of 1 μm or more and 10 μm or less; and a photosensitive layer on the undercoat layer.

general formula (1)

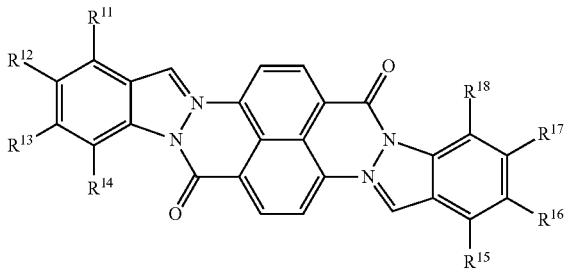

general formula (2)

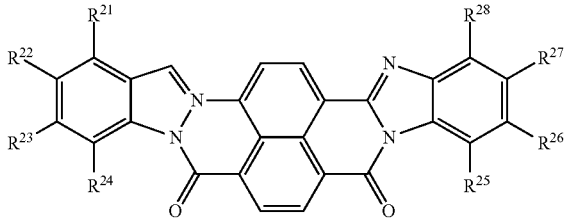

In general formula (1), $R^{11}$, $R^{12}$, $R^{13}$, $R^{14}$, $R^{15}$, $R^{16}$, $R^{17}$, and $R^{18}$ each independently represent a hydrogen atom, an alkyl group, an alkoxy group, an aralkyl group, an aryl group, an aryloxy group, an alkoxycarbonyl group, an aryloxycarbonyl group, an alkoxycarbonylalkyl group, an aryloxycarbonylalkyl group, or a halogen atom; $R^{11}$ and $R^{12}$ may be bonded to each other to form a ring, so may $R^{12}$ and $R^{13}$, and so may $R^{13}$ and $R^{14}$; and $R^{15}$ and $R^{16}$ may be bonded to each other to form a ring, so may $R^{16}$ and $R^{17}$, and so may $R^{17}$ and $R^{18}$. In general formula (2), $R^{21}$, $R^{22}$, $R^{23}$, $R^{24}$, $R^{25}$, $R^{26}$, $R^{27}$, and $R^{28}$ each independently represent a hydrogen atom, an alkyl group, an alkoxy group, an aralkyl group, an aryl group, an aryloxy group, an alkoxycarbonyl group, an aryloxycarbonyl group, an alkoxycarbonylalkyl group, an aryloxycarbonylalkyl group, or a halogen atom; $R^{21}$ and $R^{22}$ may be bonded to each other to form a ring, so may $R^{22}$ and $R^{23}$, and so may $R^{23}$ and $R^{24}$; and $R^{25}$ and $R^{26}$ may be bonded to each other to form a ring, so may $R^{26}$ and $R^{27}$, and so may $R^{27}$ and $R^{28}$.

BRIEF DESCRIPTION OF THE DRAWINGS

Exemplary embodiments of the present disclosure will be described in detail based on the following figures, wherein.

DETAILED DESCRIPTION

The exemplary embodiments of the present disclosure will now be described. These description and examples illustrate exemplary embodiments and do not limit the scope of the exemplary embodiments.

In the present disclosure, a numerical range indicated by using "to" is an inclusive range from the minimum value preceding "to" to the maximum value following "to".

When numerical ranges are described stepwise in the present disclosure, the upper limit or the lower limit of one numerical range may be substituted with an upper limit or a lower limit of a different numerical range also described stepwise. In the numerical ranges described in the present disclosure, the upper limit or the lower limit of one numerical range may be substituted with a value indicated in Examples.

In the present disclosure, the term "step" not only refers to an independent step but also any instance that achieves the desired purpose of that step although such a step is not clearly distinguishable from other steps.

In the present disclosure, each of the components may contain multiple corresponding substances. In the present disclosure, when the amount of a component in a composition is referred and when there are two or more types of substances that correspond to that component in the composition, the amount is the total amount of the two or more types of the substances in the composition unless otherwise noted.

In the present disclosure, the term "main component" refers to a major component. The main component is, for example, a component that accounts for 30 mass % or more of the total mass of a mixture containing multiple components.

In the present disclosure, the "electrophotographic photoreceptor" may be simply referred to as the "photoreceptor".

Electrophotographic Photoreceptor

A photoreceptor of the exemplary embodiment includes a conductive substrate, an undercoat layer on the conductive substrate, and a photosensitive layer on the undercoat layer.

Figure 1:
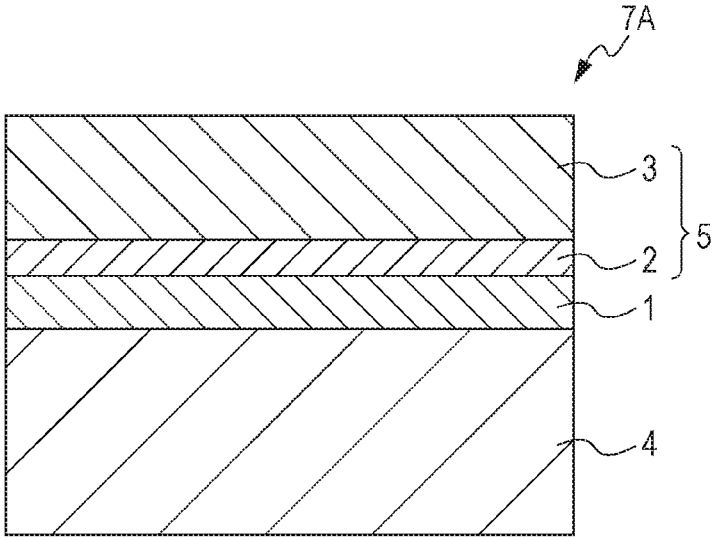
FIG. 1 is a schematic partial cross-sectional view of one example of the layer structure of an electrophotographic photoreceptor according to an exemplary embodiment.

FIG. 1 schematically illustrates one example of the layer structure of an electrophotographic photoreceptor of the exemplary embodiment. A photoreceptor 7A illustrated in FIG. 1 has a structure in which an undercoat layer 1, a charge generating layer 2, and a charge transporting layer 3 are stacked in this order on a conductive substrate 4. The charge generating layer 2 and the charge transporting layer 3 constitute a photosensitive layer 5. The photoreceptor 7A may have a layer structure in which a protective layer is further provided on the charge transporting layer 3.

The photoreceptor of this exemplary embodiment may be of a function-separated type in which the charge generating layer 2 and the charge transporting layer 3 are separately provided as in the photoreceptor 7A illustrated in FIG. 1, or may be a single-layer-type photosensitive layer in which the charge generating layer 2 and the charge transporting layer 3 are integrated.

The undercoat layer of the photoreceptor of this exemplary embodiment contains at least one perinone compound selected from the group consisting of a compound represented by general formula (1) and a compound represented by general formula (2), metal oxide particles of at least one type selected from the group consisting of aluminum oxide particles, iron oxide particles, copper oxide particles, magnesium oxide particles, calcium oxide particles, and silicon dioxide particles, and a binder resin, and has a thickness of 1 μm or more and 10 μm or less.

In the present disclosure, the compound represented by general formula (1) may also be referred to as a perinone compound (1), and the compound represented by general formula (2) may also be referred to as a perinone compound (2).

The photoreceptor according to the exemplary embodiment has an excellent charge-retaining property, suppresses occurrence of leakage current caused by being pierced with foreign matter, and suppresses an increase in residual potential that occurs by repeated image formation. The reason behind this is presumably the following mechanism.

The charge-retaining property of the photoreceptor improves when the undercoat layer contains at least one of the perinone compound (1) and the perinone compound (2); however, the undercoat layer becomes soft and prone to leakage current caused by being pierced with foreign matter. Thus, at least one type selected from aluminum oxide particles, iron oxide particles, copper oxide particles, magnesium oxide particles, calcium oxide particles, and silicon dioxide particles, which are inorganic particles and insulating substances, is added to the undercoat layer so as to physically suppress piercing of the foreign matter and electrically suppress occurrence of leakage current. When the metal oxide particles, which are an insulating substance, are contained in the undercoat layer, the residual potential may increase by repeated image formation. However, the thickness of the undercoat layer is relatively thin, namely, 1 μm or more and 10 μm or less, and this suppresses the increase in residual potential caused by repeated image formation.

In this exemplary embodiment, the metal oxide particles contained in the undercoat layer along with at least one of the perinone compound (1) and the perinone compound (2) are at least one type selected from aluminum oxide particles, iron oxide particles, copper oxide particles, magnesium oxide particles, calcium oxide particles, and silicon dioxide particles. Metal oxide particles (for example, zinc oxide particles, titanium oxide particles, and tin oxide particles) other than those described above have a relatively low insulating property and may not sufficiently suppress occurrence of leakage current.

In this exemplary embodiment, the thickness of the undercoat layer is 10 μm or less from the viewpoint of suppressing the increase in residual potential that occurs by repeated image formation. When the undercoat layer is thicker than 10 μm, residual potential tends to increase by repeated image formation. In this exemplary embodiment, the thickness of the undercoat layer is 1 μm or more from the viewpoint of suppressing the occurrence of leakage current and from the viewpoint of ease of making the undercoat layer.

In the description below, the respective layers of the photoreceptor of this exemplary embodiment are described in detail.

Undercoat Layer

The undercoat layer contains at least one compound selected from the group consisting of the perinone compound (1) and the perinone compound (2), metal oxide particles of at least one type selected from the group consisting of aluminum oxide particles, iron oxide particles, copper oxide particles, magnesium oxide particles, calcium oxide particles, and silicon dioxide particles, and a binder resin. The undercoat layer may further contain particles other than the aforementioned metal oxide particles, and other additives.

Perinone Compound (1) and Perinone Compound (2)

The undercoat layer contains at least one of a perinone compound (1) and a perinone compound (2). The perinone compound (1) is a compound represented by general formula (1) below. The perinone compound (2) is a compound represented by general formula (2) below.

general formula (1)

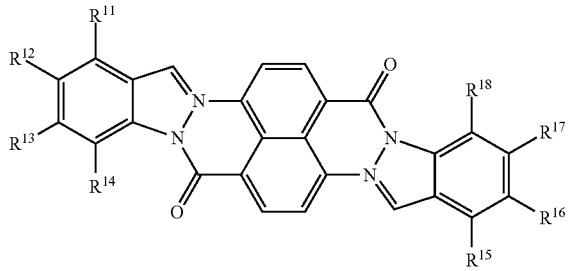

general formula (2)

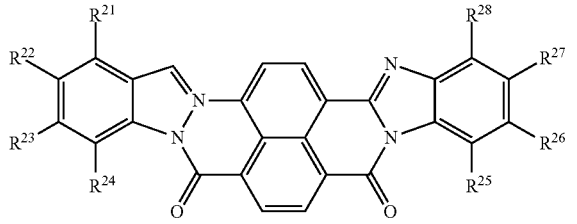

In general formula (1), $R^{11}$, $R^{12}$, $R^{13}$, $R^{14}$, $R^{15}$, $R^{16}$, $R^{17}$, and $R^{18}$ each independently represent a hydrogen atom, an alkyl group, an alkoxy group, an aralkyl group, an aryl group, an aryloxy group, an alkoxycarbonyl group, an aryloxycarbonyl group, an alkoxycarbonylalkyl group, an aryloxycarbonylalkyl group, or a halogen atom. $R^{11}$ and $R^{12}$ may be bonded to each other to form a ring, so may $R^{12}$ and $R^{13}$, and so may $R^{13}$ and $R^{14}$. $R^{15}$ and $R^{16}$ may be bonded to each other to form a ring, so may $R^{16}$ and $R^{17}$, and so may $R^{17}$ and $R^{18}$.

In general formula (2), $R^{21}$, $R^{22}$, $R^{23}$, $R^{24}$, $R^{25}$, $R^{26}$, $R^{27}$, and $R^{28}$ each independently represent a hydrogen atom, an alkyl group, an alkoxy group, an aralkyl group, an aryl group, an aryloxy group, an alkoxycarbonyl group, an aryloxycarbonyl group, an alkoxycarbonylalkyl group, an aryloxycarbonylalkyl group, or a halogen atom. $R^{21}$ and $R^{22}$ may be bonded to each other to form a ring, so may $R^{22}$ and $R^{23}$, and so may $R^{23}$ and $R^{24}$. $R^{25}$ and $R^{26}$ may be bonded to each other to form a ring, so may $R^{26}$ and $R^{27}$, and so may $R^{27}$ and $R^{28}$.

Examples of the alkyl groups represented by $R^{11}$ to $R^{18}$ in general formula (1) include substituted or unsubstituted alkyl groups.

Examples of the unsubstituted alkyl groups represented by $R^{11}$ to $R^{18}$ in general formula (1) include linear alkyl groups with 1 or more and 20 or less carbon atoms (preferably 1 or more and 10 or less carbon atoms and more preferably 1 or more and 6 or less carbon atoms), branched alkyl groups with 3 or more and 20 or less carbon atoms (preferably 3 or more and 10 or less carbon atoms), and cyclic alkyl groups with 3 or more and 20 or less carbon atoms (preferably 3 or more and 10 or less carbon atoms).

Examples of the linear alkyl groups with 1 or more and 20 or less carbon atoms include a methyl group, an ethyl group, an n-propyl group, an n-butyl group, an n-pentyl group, an n-hexyl group, an n-heptyl group, an n-octyl group, an n-nonyl group, an n-decyl group, an n-undecyl group, an n-dodecyl group, a tridecyl group, an n-tetradecyl group, an n-pentadecyl group, an n-heptadecyl group, an n-octadecyl group, an n-nonadecyl group, and an n-icosyl group.

Examples of the branched alkyl groups with 3 or more and 20 or less carbon atoms include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, a tert-decyl group, an isododecyl group, a sec-dodecyl group, a tert-dodecyl group, a tert-tetradecyl group, and a tert-pentadecyl group.

Examples of the cyclic alkyl groups with 3 or more and 20 or less carbon atoms include a cyclopropyl group, a cyclobutyl group, a cyclopentyl group, a cyclohexyl group, a cycloheptyl group, a cyclooctyl group, a cyclononyl group, a cyclodecyl group, and polycyclic (for example, bicyclic, tricyclic, and spirocyclic) alkyl groups in which these monocyclic alkyl groups are bonded.

Among these, linear alkyl groups such as a methyl group and an ethyl group may be used as the unsubstituted alkyl groups.

Examples of the substituent in the alkyl group include an alkoxy group, a hydroxy group, a carboxy group, a nitro group, and a halogen atom (fluorine atom, bromine atom, iodine atom, etc.).

Examples of the alkoxy group that substitutes the hydrogen atom in the alkyl group include the same groups as those unsubstituted alkoxy groups represented by $R^{11}$ to $R^{18}$ in general formula (1).

Examples of the alkoxy groups represented by $R^{11}$ to $R^{18}$ in general formula (1) include substituted or unsubstituted alkoxy groups.

Examples of the unsubstituted alkoxy groups represented by $R^{11}$ to $R^{18}$ in general formula (1) include linear, branched, and cyclic alkoxy groups with 1 or more and 10 or less (preferably 1 or more and 6 or less and more preferably 1 or more and 4 or less) carbon atoms.

Specific examples of the linear alkoxy group include a methoxy group, an ethoxy group, an n-propoxy group, an n-butoxy group, an n-pentyloxy group, an n-hexyloxy group, an n-heptyloxy group, an n-octyloxy group, an n-nonyloxy group, and an n-decyloxy group.

Specific examples of the branched alkoxy group include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, and a tert-decyloxy group.

Specific examples of the cyclic alkoxy group include a cyclopropoxy group, a cyclobutoxy group, a cyclopentyloxy group, a cyclohexyloxy group, a cycloheptyloxy group, a cyclooctyloxy group, a cyclononyloxy group, and a cyclodecyloxy group.

Among these, a linear alkoxy group may be used as the unsubstituted alkoxy group.

Examples of the substituent in the alkoxy group include an aryl group, an alkoxycarbonyl group, an aryloxycarbonyl group, a hydroxyl group, a carboxy group, a nitro group, and a halogen atom (fluorine atom, bromine atom, iodine atom, etc.).

Examples of the aryl group that substitutes the hydrogen atom in the alkoxy group include the same groups as those unsubstituted aryl groups represented by $R^{11}$ to $R^{18}$ in general formula (1).

Examples of the alkoxycarbonyl group that substitutes the hydrogen atom in the alkoxy group include the same groups as those unsubstituted alkoxycarbonyl groups represented by $R^{11}$ to $R^{18}$ in general formula (1).

Examples of the aryloxycarbonyl group that substitutes the hydrogen atom in the alkoxy group include the same groups as those unsubstituted aryloxycarbonyl groups represented by $R^{11}$ to $R^{18}$ in general formula (1).

Examples of the aralkyl groups represented by $R^{11}$ to $R^{18}$ in general formula (1) include substituted or unsubstituted aralkyl groups.

The unsubstituted aralkyl groups represented by $R^{11}$ to $R^{18}$ in general formula (1) are preferably aralkyl groups with 7 or more and 30 or less carbon atoms, more preferably aralkyl groups with 7 or more and 16 or less carbon atoms, and yet more preferably aralkyl groups with 7 or more and 12 or less carbon atoms.

Examples of the unsubstituted aralkyl group with 7 or more and 30 or less carbon atoms include a benzyl group, a phenylethyl group, a phenylpropyl group, a 4-phenylbutyl group, a phenylpentyl group, a phenylhexyl group, a phenylheptyl group, a phenyloctyl group, a phenylnonyl group, a naphthylmethyl group, a naphthylethyl group, an anthracylmethyl group, and a phenyl-cyclopentylmethyl group.

Examples of the substituent in the aralkyl group include an alkoxy group, an alkoxycarbonyl group, an aryloxycarbonyl group, and a halogen atom (fluorine atom, bromine atom, iodine atom, etc.).

Examples of the alkoxy group that substitutes the hydrogen atom in the aralkyl group include the same groups as those unsubstituted alkoxy groups represented by $R^{11}$ to $R^{18}$ in general formula (1).

Examples of the alkoxycarbonyl group that substitutes the hydrogen atom in the aralkyl group include the same groups as those unsubstituted alkoxycarbonyl groups represented by $R^{11}$ to $R^{18}$ in general formula (1).

Examples of the aryloxycarbonyl group that substitutes the hydrogen atom in the aralkyl group include the same groups as those unsubstituted aryloxycarbonyl groups represented by $R^{11}$ to $R^{18}$ in general formula (1).

Examples of the aryl groups represented by $R^{11}$ to $R^{18}$ in general formula (1) include substituted or unsubstituted aryl groups.

The unsubstituted aryl groups represented by $R^{11}$ to $R^{18}$ in general formula (1) are preferably aryl groups with 6 or more and 30 or less carbon atoms, more preferably aryl groups with 6 or more and 14 or less carbon atoms, and yet more preferably aryl groups with 6 or more and 10 or less carbon atoms.

Examples of the aryl groups with 6 or more and 30 or less carbon atoms include a phenyl group, a biphenyl group, a 1-naphthyl group, a 2-naphthyl group, a 9-anthryl group, a 9-phenanthryl group, a 1-pyrenyl group, a 5-naphthacenyl group, a 1-indenyl group, a 2-azulenyl group, a 9-fluorenyl group, a biphenylenyl group, an indacenyl group, a fluoranthenyl group, an acenaphthylenyl group, an aceantrylenyl group, a phenalenyl group, a fluorenyl group, an anthryl group, a bianthracenyl group, a teranthracenyl group, a quarteranthracenyl group, an anthraquinolyl group, a phenanthryl group, a triphenylenyl group, a pyrenyl group, a chrysenyl group, a naphthacenyl group, a preadenyl group, a picenyl group, a perylenyl group, a pentaphenyl group, a pentacenyl group, a tetraphenylenyl group, a hexaphenyl group, a hexacenyl group, a rubicenyl group, and a coronenyl group. Among these, a phenyl group may be used.

Examples of the substituent in the aryl group include an alkyl group, an alkoxy group, an alkoxycarbonyl group, an aryloxycarbonyl group, and a halogen atom (fluorine atom, bromine atom, iodine atom, etc.).

Examples of the alkyl group that substitutes the hydrogen atom in the aryl group include the same groups as those unsubstituted alkyl groups represented by $R^{11}$ to $R^{18}$ in general formula (1).

Examples of the alkoxy group that substitutes the hydrogen atom in the aryl group include the same groups as those unsubstituted alkoxy groups represented by $R^{11}$ to $R^{18}$ in general formula (1).

Examples of the alkoxycarbonyl group that substitutes the hydrogen atom in the aryl group include the same groups as those unsubstituted alkoxycarbonyl groups represented by $R^{11}$ to $R^{18}$ in general formula (1).

Examples of the aryloxycarbonyl group that substitutes the hydrogen atom in the aryl group include the same groups as those unsubstituted aryloxycarbonyl groups represented by $R^{11}$ to $R^{18}$ in general formula (1).

Examples of the aryloxy groups (—O—Ar where Ar represents an aryl group) represented by $R^{11}$ to $R^{18}$ in general formula (1) include substituted or unsubstituted aryloxy groups.

The unsubstituted aryloxy groups represented by $R^{11}$ to $R^{18}$ in general formula (1) are preferably aryloxy groups with 6 or more and 30 or less carbon atoms, more preferably aryloxy groups with 6 or more and 14 or less carbon atoms, and yet more preferably aryloxy groups with 6 or more and 10 or less carbon atoms.

Examples of the aryloxy groups with 6 or more and 30 or less carbon atoms include a phenyloxy group (phenoxy group), a biphenyloxy group, a 1-naphthyloxy group, a 2-naphthyloxy group, a 9-anthryloxy group, a 9-phenanthryloxy group, a 1-pyrenyloxy group, a 5-naphthacenyloxy group, a 1-indenyloxy group, a 2-azulenyloxy group, a 9-fluorenyloxy group, a biphenylenyloxy group, an indacenyloxy group, a fluoranthenyloxy group, an acenaphthylenyloxy group, an aceantrylenyloxy group, a phenalenyloxy group, a fluorenyloxy group, an anthryloxy group, a bianthracenyloxy group, a teranthracenyloxy group, a quarteranthracenyloxy group, an anthraquinolyloxy group, a phenanthryloxy group, a triphenylenyloxy group, a pyrenyloxy group, a chrysenyloxy group, a naphthacenyloxy group, a preadenyloxy group, a picenyloxy group, a perylenyloxy group, a pentaphenyloxy group, a pentacenyloxy group, a tetraphenylenyloxy group, a hexaphenyloxy group, a hexacenyloxy group, a rubicenyloxy group, and a coronenyloxy group. Among these, a phenyloxy group (phenoxy group) may be used.

Examples of the substituent in the aryloxy group include an alkyl group, an alkoxycarbonyl group, an aryloxycarbonyl group, and a halogen atom (fluorine atom, bromine atom, iodine atom, etc.).

Examples of the alkyl group that substitutes the hydrogen atom in the aryloxy group include the same groups as those unsubstituted alkyl groups represented by $R^{11}$ to $R^{18}$ in general formula (1).

Examples of the alkoxycarbonyl group that substitutes the hydrogen atom in the aryloxy group include the same groups as those unsubstituted alkoxycarbonyl groups represented by $R^{11}$ to $R^{18}$ in general formula (1).

Examples of the aryloxycarbonyl group that substitutes the hydrogen atom in the aryloxy group include the same groups as those unsubstituted aryloxycarbonyl groups represented by $R^{11}$ to $R^{18}$ in general formula (1).

Examples of the alkoxycarbonyl groups (—CO—OR where R represents an alkyl group) represented by $R^{11}$ to $R^{18}$ in general formula (1) include substituted or unsubstituted alkoxycarbonyl groups.

The number of carbon atoms in the alkyl chain in the unsubstituted alkoxycarbonyl groups represented by $R^{11}$ to $R^{18}$ in general formula (1) is preferably 1 or more and 20 or less, more preferably 1 or more and 15 or less, and yet more preferably 1 or more and 10 or less.

Examples of the alkoxycarbonyl group having an alkyl chain with 1 or more and 20 or less carbon atoms include a methoxycarbonyl group, an ethoxycarbonyl group, a propoxycarbonyl group, an isopropoxycarbonyl group, an n-butoxycarbonyl group, a sec-butoxybutylcarbonyl group, a tert-butoxycarbonyl group, a pentaoxycarbonyl group, a hexaoxycarbonyl group, a heptaoxycarbonyl group, an octaoxycarbonyl group, a nonaoxycarbonyl group, a decaoxycarbonyl group, a dodecaoxycarbonyl group, a tridecaoxycarbonyl group, a tetradecaoxycarbonyl group, a pentadecaoxycarbonyl group, a hexadecaoxycarbonyl group, a heptadecaoxycarbonyl group, an octadecaoxycarbonyl group, a nonadecaoxycarbonyl group, and an icosaoxycarbonyl group.

Examples of the substituent in the alkoxycarbonyl group include an aryl group, a hydroxy group, and a halogen atom (fluorine atom, bromine atom, iodine atom, etc.).

Examples of the aryl group that substitutes the hydrogen atom in the alkoxycarbonyl group include the same groups as those unsubstituted aryl groups represented by $R^{11}$ to $R^{18}$ in general formula (1).

Examples of the aryloxycarbonyl groups (—CO—OAr where Ar represents an aryl group) represented by $R^{11}$ to $R^{18}$ in general formula (1) include substituted or unsubstituted aryloxycarbonyl groups.

The number of carbon atoms in the aryl group in the unsubstituted aryloxycarbonyl groups represented by $R^{11}$ to $R^{18}$ in general formula (1) is preferably 6 or more and 30 or less, more preferably 6 or more and 14 or less, and yet more preferably 6 or more and 10 or less.

Examples of the aryloxycarbonyl group having an aryl group with 6 or more and 30 or less carbon atoms include a phenoxycarbonyl group, a biphenyloxycarbonyl group, a 1-naphthyloxycarbonyl group, a 2-naphthyloxycarbonyl group, a 9-anthryloxycarbonyl group, a 9-phenanthryloxycarbonyl group, a 1-pyrenyloxycarbonyl group, a 5-naphthacenyloxycarbonyl group, a 1-indenyloxycarbonyl group, a 2-azulenyloxycarbonyl group, a 9-fluorenyloxycarbonyl group, a biphenylenyloxycarbonyl group, an indacenyloxycarbonyl group, a fluoranthenyloxycarbonyl group, an acenaphthylenyloxycarbonyl group, an aceantrylenyloxycarbonyl group, a phenalenyloxycarbonyl group, a fluorenyloxycarbonyl group, an anthryloxycarbonyl group, a bianthracenyloxycarbonyl group, a teranthracenyloxycarbonyl group, a quarteranthracenyloxycarbonyl group, an anthraquinolyloxycarbonyl group, a phenanthryloxycarbonyl group, a triphenylenyloxycarbonyl group, a pyrenyloxycarbonyl group, a chrysenyloxycarbonyl group, a naphthacenyloxycarbonyl group, a preadenyloxycarbonyl group, a picenyloxycarbonyl group, a perylenyloxycarbonyl group, a pentaphenyloxycarbonyl group, a pentacenyloxycarbonyl group, a tetraphenylenyloxycarbonyl group, a hexaphenyloxycarbonyl group, a hexacenyloxycarbonyl group, a rubicenyloxycarbonyl group, and a coronenyloxycarbonyl group. Among these, a phenoxycarbonyl group may be used.

Examples of the substituent in the aryloxycarbonyl group include an alkyl group, a hydroxy group, and a halogen atom (fluorine atom, bromine atom, iodine atom, etc.).

Examples of the alkyl group that substitutes the hydrogen atom in the aryloxycarbonyl group include the same groups as those unsubstituted alkyl groups represented by $R^{11}$ to $R^{18}$ in general formula (1).

Examples of the alkoxycarbonylalkyl groups (—($C_nH_{2n}$)—CO—OR where R represents an alkyl group and n represents an integer of 1 or more) represented by $R^{11}$ to $R^{18}$ in general formula (1) include substituted or unsubstituted alkoxycarbonylalkyl groups.

Examples of the alkoxycarbonyl group (—CO—OR) in the unsubstituted alkoxycarbonylalkyl groups represented by $R^{11}$ to $R^{18}$ in general formula (1) include the same groups as those alkoxycarbonyl groups represented by $R^{11}$ to $R^{18}$ in general formula (1).

Examples of the alkylene chain (—$C_nH_{2n}$—) in the unsubstituted alkoxycarbonylalkyl groups represented by $R^{11}$ to $R^{18}$ in general formula (1) include linear alkylene chains with 1 or more and 20 or less carbon atoms (preferably 1 or more and 10 or less carbon atoms and more preferably 1 or more and 6 or less carbon atoms), branched alkylene chains with 3 or more and 20 or less carbon atoms (preferably 3 or more and 10 or less carbon atoms), and cyclic alkylene chains with 3 or more and 20 or less carbon atoms (preferably 3 or more and 10 or less carbon atoms).

Examples of the linear alkylene chain with 1 or more and 20 or less carbon atoms include a methylene group, an ethylene group, an n-propylene group, an n-butylene group, an n-pentylene group, an n-hexylene group, an n-heptylene group, an n-octylene group, an n-nonylene group, an n-decylene group, an n-undecylene group, an n-dodecylene group, a tridecylene group, an n-tetradecylene group, an n-pentadecylene group, an n-heptadecylene group, an n-octadecylene group, an n-nonadecylene group, and an n-icosylene group.

Examples of the branched alkylene chain with 3 or more and 20 or less carbon atoms include an isopropylene group, an isobutylene group, a sec-butylene group, a tert-butylene group, an isopentylene group, a neopentylene group, a tert-pentylene group, an isohexylene group, a sec-hexylene group, a tert-hexylene group, an isoheptylene group, a sec-heptylene group, a tert-heptylene group, an isooctylene group, a sec-octylene group, a tert-octylene group, an isononylene group, a sec-nonylene group, a tert-nonylene group, an isodecylene group, a sec-decylene group, a tert-decylene group, an isododecylene group, a sec-dodecylene group, a tert-dodecylene group, a tert-tetradecylene group, and a tert-pentadecylene group.

Examples of the cyclic alkylene chain with 3 or more and 20 or less carbon atoms include a cyclopropylene group, a cyclobutylene group, a cyclopentylene group, a cyclohexylene group, a cycloheptylene group, a cyclooctylene group, a cyclononylene group, and a cyclodecylene group.

Examples of the substituent in the alkoxycarbonylalkyl group include an aryl group, a hydroxy group, and a halogen atom (fluorine atom, bromine atom, iodine atom, etc.).

Examples of the aryl group that substitutes the hydrogen atom in the alkoxycarbonylalkyl group include the same groups as those unsubstituted aryl groups represented by $R^{11}$ to $R^{18}$ in general formula (1).

Examples of the aryloxycarbonylalkyl groups (—($C_nH_{2n}$)—CO—OAr where Ar represents an aryl group and n represents an integer of 1 or more) represented by $R^{11}$ to $R^{18}$ in general formula (1) include substituted or unsubstituted aryloxycarbonylalkyl groups.

Examples of the aryloxycarbonyl group (—CO—OAr where Ar represents an aryl group) in the unsubstituted aryloxycarbonylalkyl groups represented by $R^{11}$ to $R^{18}$ in general formula (1) include the same groups as those aryloxycarbonyl groups represented by $R^{11}$ to $R^{18}$ in general formula (1).

Examples of alkylene chain (—$C_nH_{2n}$—) in the unsubstituted aryloxycarbonylalkyl groups represented by $R^{11}$ to $R^{18}$ in general formula (1) include the same groups as those alkylene chains in the alkoxycarbonylalkyl groups represented by $R^{11}$ to $R^{18}$ in general formula (1).

Examples of the substituent in the aryloxycarbonylalkyl group include an alkyl group, a hydroxy group, and a halogen atom (fluorine atom, bromine atom, iodine atom, etc.).

Examples of the alkyl group that substitutes the hydrogen atom in the aryloxycarbonylalkyl group include the same groups as those unsubstituted alkyl groups represented by $R^{11}$ to $R^{18}$ in general formula (1).

Examples of the halogen atoms represented by $R^{11}$ to $R^{18}$ in general formula (1) include a fluorine atom, a chlorine atom, a bromine atom, and an iodine atom.

In general formula (1), examples of the ring structure formed as a result of bonding between $R^{11}$ and $R^{12}$, $R^{12}$ and $R^{13}$, $R^{13}$ and $R^{14}$, $R^{15}$ and $R^{16}$, $R^{16}$ and $R^{17}$, or $R^{17}$ and $R^{18}$ include a benzene ring and fused rings with 10 or more and 18 or less carbon atoms (a naphthalene ring, an anthracene ring, a phenanthrene ring, a chrysene ring (benzo[a]phenanthrene ring), a tetracene ring, a teraphene ring (benzo[α]anthracene ring), a triphenylene ring, etc.). Among these, a benzene ring is preferable as the ring structure to be formed.

Examples of the alkyl groups represented by $R^{21}$ to $R^{28}$ in general formula (2) include the same groups as those alkyl groups represented by $R^{11}$ to $R^{18}$ in general formula (1).

Examples of the alkoxy groups represented by $R^{21}$ to $R^{28}$ in general formula (2) include the same groups as those alkoxy groups represented by $R^{11}$ to $R^{18}$ in general formula (1).

Examples of the aralkyl groups represented by $R^{21}$ to $R^{28}$ in general formula (2) include the same groups as those aralkyl groups represented by $R^{11}$ to $R^{18}$ in general formula (1).

Examples of the aryl groups represented by $R^{21}$ to $R^{28}$ in general formula (2) include the same groups as those aryl groups represented by $R^{11}$ to $R^{18}$ in general formula (1).

Examples of the aryloxy groups represented by $R^{21}$ to $R^{28}$ in general formula (2) include the same groups as those aryloxy groups represented by $R^{11}$ to $R^{18}$ in general formula (1).

Examples of the alkoxycarbonyl groups represented by $R^{21}$ to $R^{28}$ in general formula (2) include the same groups as those alkoxycarbonyl groups represented by $R^{11}$ to $R^{18}$ in general formula (1).

Examples of the aryloxycarbonyl groups represented by $R^{21}$ to $R^{28}$ in general formula (2) include the same groups as those aryloxycarbonyl groups represented by $R^{11}$ to $R^{18}$ in general formula (1).

Examples of the alkoxycarbonylalkyl groups represented by $R^{21}$ to $R^{28}$ in general formula (2) include the same groups as those alkoxycarbonylalkyl groups represented by $R^{11}$ to $R^{18}$ in general formula (1).

Examples of the aryloxycarbonylalkyl groups represented by $R^{21}$ to $R^{28}$ in general formula (2) include the same groups as those aryloxycarbonylalkyl groups represented by $R^{11}$ to $R^{18}$ in general formula (1).

Examples of the halogen atoms represented by $R^{21}$ to $R^{28}$ in general formula (2) include the same atoms as those halogen atoms represented by $R^{11}$ to $R^{18}$ in general formula (1).

In general formula (2), examples of the ring structure formed as a result of bonding between $R^{21}$ and $R^{22}$, $R^{22}$ and $R^{23}$, $R^{23}$ and $R^{24}$, $R^{25}$ and $R^{26}$, $R^{26}$ and $R^{27}$, or $R^{27}$ and $R^{28}$ include a benzene ring and fused rings with 10 or more and 18 or less carbon atoms (a naphthalene ring, an anthracene ring, a phenanthrene ring, a chrysene ring (benzo[a]phenanthrene ring), a tetracene ring, a teraphene ring (benzo[α]anthracene ring), a triphenylene ring, etc.). Among these, a benzene ring is preferable as the ring structure to be formed.

From the viewpoint of further suppressing degradation of the photosensitivity and the increase in residual potential that occur by repeated image formation, in general formula (1), $R^{11}$, $R^{12}$, $R^{13}$, $R^{14}$, $R^{15}$, $R^{16}$, $R^{17}$, and $R^{18}$ may each independently represent a hydrogen atom, an alkyl group, an alkoxycarbonyl group, an aryloxycarbonyl group, an alkoxycarbonylalkyl group, or an aryloxycarbonylalkyl group.

From the viewpoint of further suppressing degradation of the photosensitivity and the increase in residual potential that occur by repeated image formation, in general formula (2), $R^{21}$, $R^{22}$, $R^{23}$, $R^{24}$, $R^{25}$, $R^{26}$, $R^{27}$, and $R^{28}$ may each independently represent a hydrogen atom, an alkyl group, an alkoxycarbonyl group, an aryloxycarbonyl group, an alkoxycarbonylalkyl group, or an aryloxycarbonylalkyl group.

Specific examples of the perinone compound (1) and the perinone compound (2) are described below, but the exemplary embodiment is not limited by these examples. In the structural formulae below, Ph represents a phenyl group.

1-1

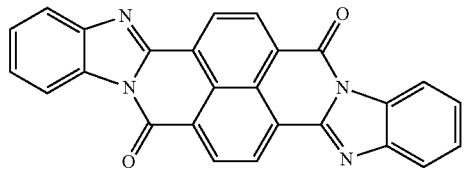

1-2

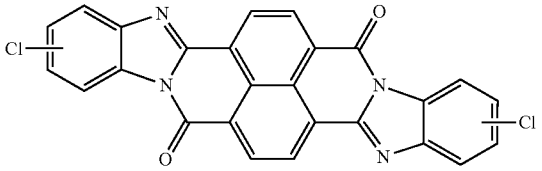

1-3

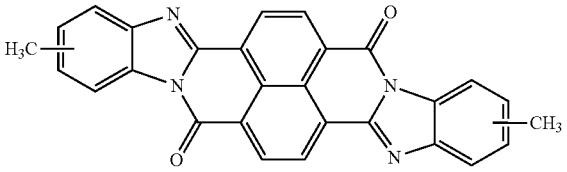

-continued
1-4
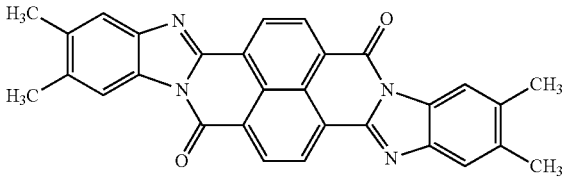
1-5
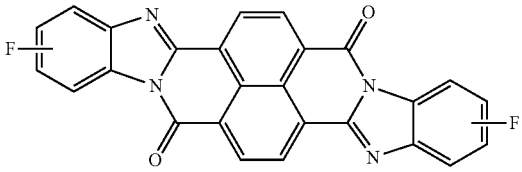
1-6
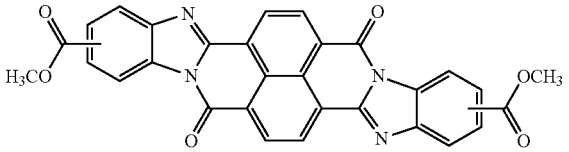
1-7
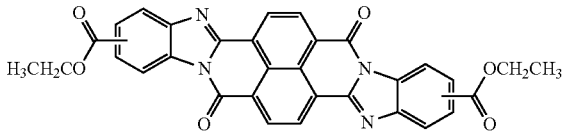
1-8
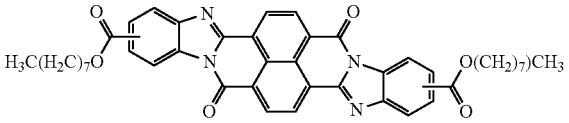
1-9
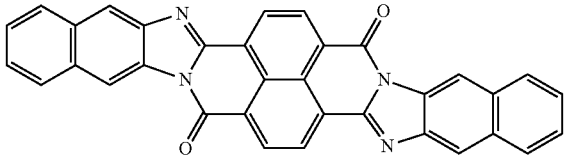
1-10
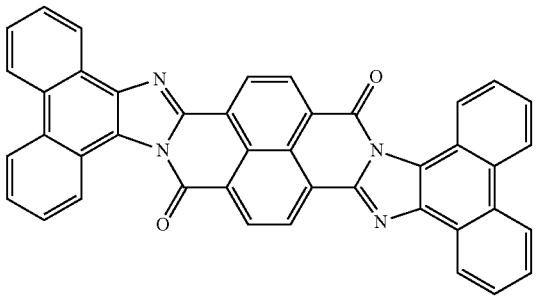
1-11
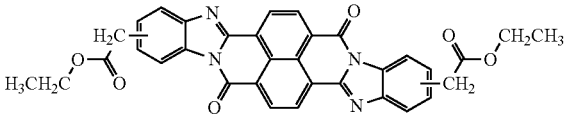
-continued
1-12
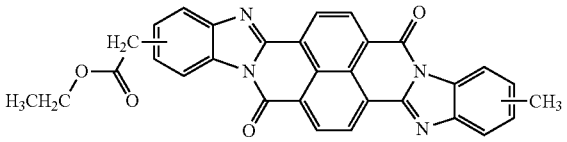
1-13
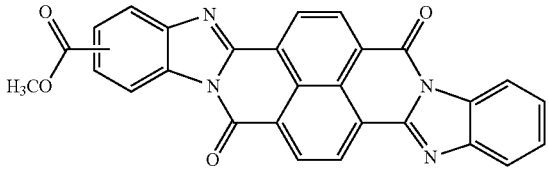
1-14
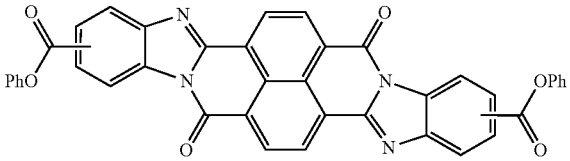
1-15
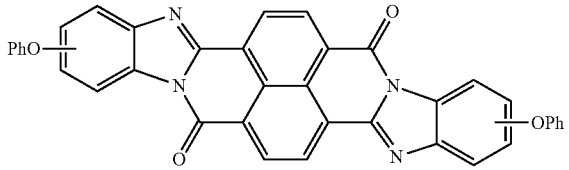
1-16
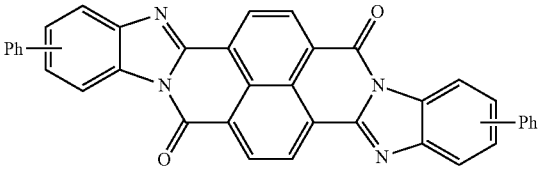
1-17
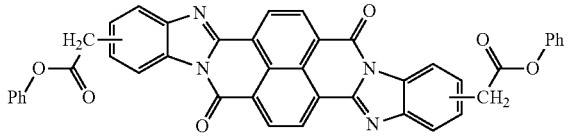
1-18
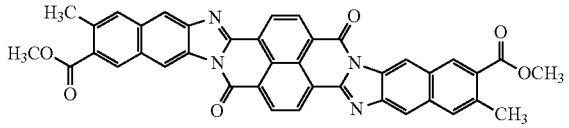
2-1
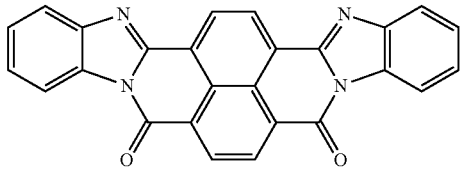

-continued
2-2
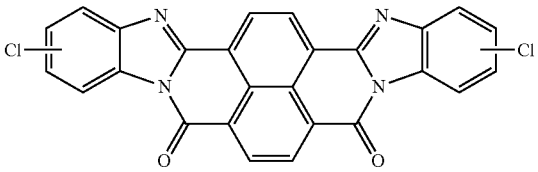
2-3
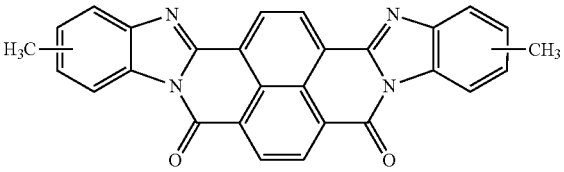
2-4
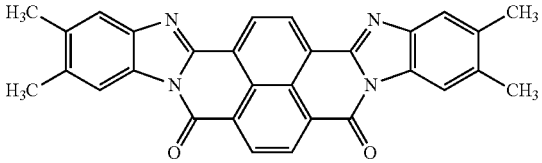
2-5
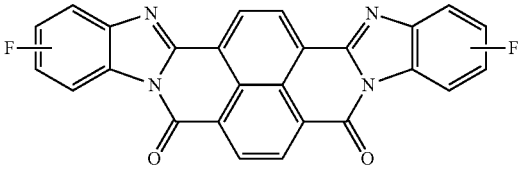
2-6
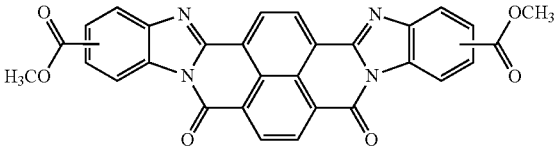
2-7
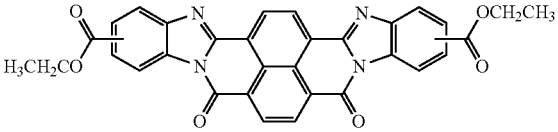
2-8
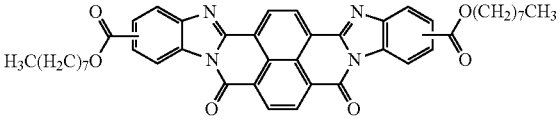
2-9
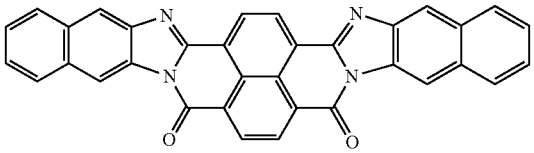
-continued
2-10
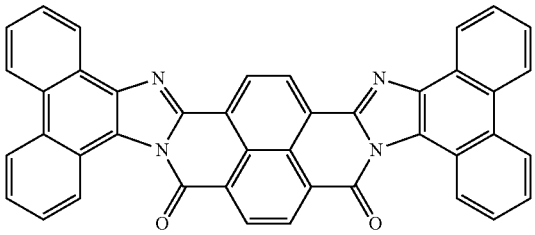
2-11
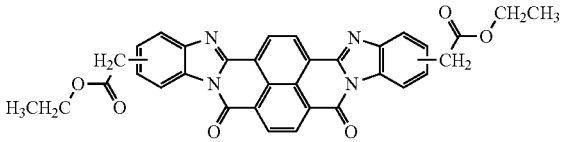
2-12
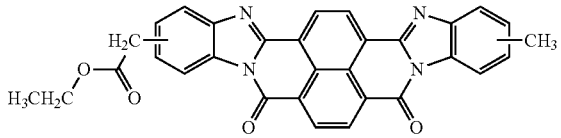
2-13
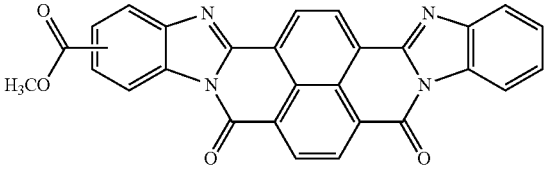
2-14
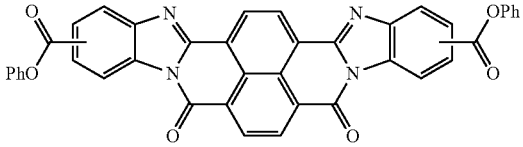
2-15
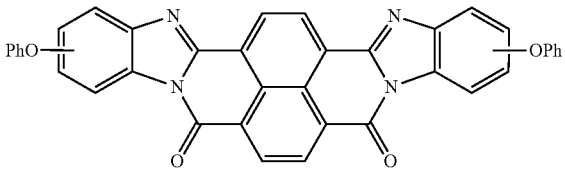
2-16
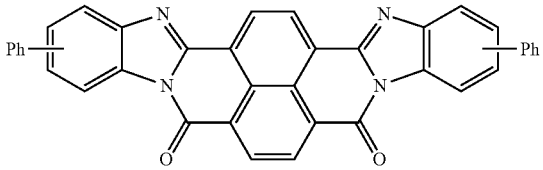
2-17
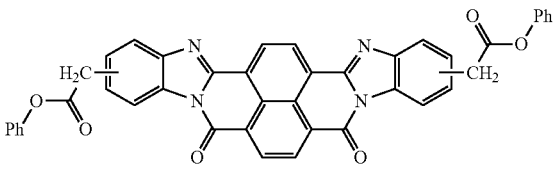

-continued 2-18

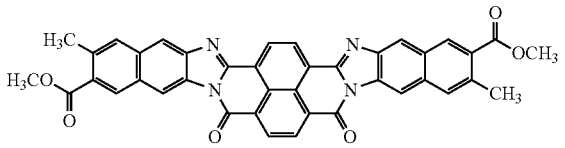

The perinone compound (1) and the perinone compound (2) are isomeric to each other (in other words, have a cis/trans relationship). According to a typical synthesis method, 2 moles of an orthophenylenediamine compound and 1 mole of naphthalenetetracarboxylic acid compound are heated and fused, as a result of which a mixture of a cis isomer and a trans isomer is obtained. Typically, the mixing ratio is greater for the cis isomer than the trans isomer. The cis isomer and the trans isomer can be isolated from each other by, for example, heating and washing the mixture with an alcohol solution of potassium hydroxide since the cis isomer is soluble and the trans isomer is sparingly soluble in this solution.

The total amount of the perinone compound (1) and the perinone compound (2) relative to the total solid content of the undercoat layer is preferably 30 mass % or more and 90 mass % or less, more preferably 40 mass % or more and 80 mass % or less, yet more preferably 45 mass % or more and 75 mass % or less, and still more preferably 50 mass % or more and 70 mass % or less from the viewpoint of controlling the volume resistivity of the undercoat layer to be within a desirable range and from the viewpoint of the film forming property.

Metal Oxide Particles

The undercoat layer contains metal oxide particles of at least one type selected from the group consisting of aluminum oxide particles (hereinafter may also be referred to as alumina), iron oxide particles, copper oxide particles, magnesium oxide particles, calcium oxide particles, and silicon dioxide particles (hereinafter may also be referred to as silica).

The metal oxide particles may be surface-treated. Examples of the surface treatment agent for the metal oxide particles include a silane coupling agent, a titanate-based coupling agent, an aluminum-based coupling agent, and a surfactant. The metal oxide particles may be a mixture of two or more types of metal oxide particles of different metals, metal particles subjected to different surface treatments, or metal oxide particles having different particle diameters.

From the viewpoint of the dispersibility in the undercoat layer, the metal oxide particles of at least one type selected from the group consisting of aluminum oxide particles, iron oxide particles, copper oxide particles, magnesium oxide particles, calcium oxide particles, and silicon dioxide particles contained in the undercoat layer preferably has an average primary particle diameter of 10 nm or more, more preferably 50 nm or more, yet more preferably 100 nm or more, still more preferably 150 nm or more, and more preferably 200 nm or more, and preferably has an average primary particle diameter of 1000 nm or less, more preferably 900 nm or less, still more preferably 800 nm or less, yet more preferably 600 nm or less, and more preferably 400 nm or less.

The average primary particle diameter of the metal oxide particles contained in the undercoat layer is determined by observing a section of the undercoat layer with a scanning electron microscope (SEM), measuring the long axis lengths of one hundred metal oxide particles selected at random, and averaging the long axis lengths of the one hundred particles.

The total volume of metal oxide particles of at least one type selected from the group consisting of aluminum oxide particles, iron oxide particles, copper oxide particles, magnesium oxide particles, calcium oxide particles, and silicon dioxide particles in the undercoat layer is preferably 10 vol % or more, more preferably 15 vol % or more, and yet more preferably 20 vol % or more from the viewpoint of suppressing occurrence of leakage current caused by being pierced with foreign matter. The total volume of metal oxide particles of at least one type selected from the group consisting of aluminum oxide particles, iron oxide particles, copper oxide particles, magnesium oxide particles, calcium oxide particles, and silicon dioxide particles in the undercoat layer is preferably 35 vol % or less, more preferably 30 vol % or less, yet more preferably 25 vol % or less, still more preferably 20 vol % or less, and more preferably 15 vol % or less from the viewpoint of photosensitivity and suppressing residual potential.

The volume ratio of the metal oxide particles in the undercoat layer is determined by observing a section of the undercoat layer with a scanning electron microscope (SEM) and by the method described below.

In a SEM image, a particular area S is specified in the undercoat layer, and the total area A of the metal oxide particles contained in the area S is determined. Assuming that the undercoat layer is homogeneous, the value obtained by dividing the total area A of the metal oxide particles by the area S is converted into a percentage value (%) and this value is used as the volume ratio of the metal oxide particles in the undercoat layer. The area S is set to an area sufficiently large relative to the size of the metal oxide particles. For example, the area S contains one hundred or more metal oxide particles. The area S may be a total of two or more sections.

The total content of metal oxide particles of at least one type selected from the group consisting of aluminum oxide particles, iron oxide particles, copper oxide particles, magnesium oxide particles, calcium oxide particles, and silicon dioxide particles relative to the total solid content in the undercoat layer is preferably 5 mass % or more, more preferably 10 mass % or more, and yet more preferably 15 mass % or more from the viewpoint of suppressing occurrence of leakage current caused by being pierced with foreign matter. The total content of metal oxide particles of at least one type selected from the group consisting of aluminum oxide particles, iron oxide particles, copper oxide particles, magnesium oxide particles, calcium oxide particles, and silicon dioxide particles relative to the total solid content in the undercoat layer is preferably less than 30 mass %, more preferably 25 mass % or less, and yet more preferably 20 mass % or less from the viewpoint of photosensitivity and suppressing residual potential.

The total content of the metal oxide particles of at least one type selected from the group consisting of aluminum oxide particles, iron oxide particles, copper oxide particles, magnesium oxide particles, calcium oxide particles, and silicon dioxide particles contained in the undercoat layer is preferably 20 mass % or more, more preferably 25 mass % or more, and yet more preferably 30 mass % or more, and is preferably 70 mass % or less, more preferably 65 mass % or less, yet more preferably 60 mass % or less, and still more preferably 50 mass % or less relative to the total content of the perinone compound (1) and the perinone compound (2)

contained in the undercoat layer from the viewpoint of photosensitivity and suppressing residual potential.

Binder Resin

Examples of the binder resin used in the undercoat layer include known materials such as known polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and silane coupling agents.

Other examples of the binder resin used in the undercoat layer include charge transporting resins that have charge transporting groups, and conductive resins (for example, polyaniline).

Among these, a resin that is insoluble in the coating solvent in the overlying layer is suitable as the binder resin used in the undercoat layer. Examples of the particularly suitable resin include thermosetting resins such as a urea resin, a phenolic resin, a phenol-formaldehyde resin, a melamine resin, a polyurethane resin, an unsaturated polyester resin, an alkyd resin, and an epoxy resin; and a resin obtained by a reaction between a curing agent and at least one resin selected from the group consisting of a polyamide resin, a polyester resin, a polyether resin, a methacrylic resin, an acrylic resin, a polyvinyl alcohol resin, and a polyvinyl acetal resin. When two or more of these binder resins are used in combination, the mixing ratios are set as necessary.

The binder resin used in the undercoat layer may be polyurethane from the viewpoint of thoroughly dispersing the perinone compound and the metal oxide particles.

Polyurethane is typically synthesized by a polyaddition reaction between a polyfunctional isocyanate and a polyol.

Examples of the polyfunctional isocyanate include diisocyanates such as methylene diisocyanate, ethylene diisocyanate, isophorone diisocyanate, hexamethylene diisocyanate, 1,4-cyclohexane diisocyanate, 2,4-toluene diisocyanate, 2,6-toluene diisocyanate, 1,3-xylylene diisocyanate, 1,5-naphthalene diisocyanate, m-phenylene diisocyanate, p-phenylene diisocyanate, 3,3'-dimethyl-4,4'-diphenylmethane diisocyanate, 3,3'-dimethylbiphenylene diisocyanate, 4,4'-biphenylene diisocyanate, dicyclohexylmethane diisocyanate, and methylene bis(4-cyclohexyl isocyanate); isocyanurates obtained by trimerizing these diisocyanates; and blocked isocyanates obtained by blocking the isocyanate groups of the diisocyanates with a blocking agent. Polyfunctional isocyanates may be used alone or in combination.

Examples of the polyol include diols such as ethylene glycol, 1,2-propanediol, 1,3-propanediol, 1,2-butanediol, 1,3-butanediol, 2,3-butanediol, 2,2-dimethyl-1,3-propanediol, 1,2-pentanediol, 1,4-pentanediol, 1,5-pentanediol, 2,4-pentanediol, 3,3-dimethyl-1,2-butanediol, 2-ethyl-2-methyl-1,3-propanediol, 1,2-hexanediol, 1,5-hexanediol, 1,6-hexanediol, 2,5-hexanediol, 2-methyl-2,4-pentanediol, 2,2-diethyl-1,3-propanediol, 2,4-dimethyl-2,4-pentanediol, 1,7-heptanediol, 2-methyl-2-propyl-1,3-propanediol, 2,5-dimethyl-2,5-hexanediol, 2-ethyl-1,3-hexanediol, 1,2-octanediol, 1,8-octanediol, 2,2,4-trimethyl-1,3-pentanediol, 1,4-cyclohexanedimethanol, hydroquinone, diethylene glycol, triethylene glycol, dipropylene glycol, tripropylene glycol, polyethylene glycol, polypropylene glycol, poly(oxytetramethylene)glycol, 4,4'-dihydroxy-diphenyl-2,2-propane, and 4,4'-dihydroxyphenylsulfone.

Examples of the polyol further include polyester polyol, polycarbonate polyol, polycaprolactone polyol, polyether polyol, and polyvinyl butyral.

Polyols may be used alone or in combination.

Examples of the urethane-curing catalyst (in other words, a catalyst of the polyaddition reaction between a polyfunctional isocyanate and a polyol) include known organic acid metal salts and organic metal complexes.

The binder resin contained in the undercoat layer preferably contains 80 mass % or more and 100 mass % or less, more preferably 90 mass % or more and 100 mass % or less, and yet more preferably 95 mass % or more and 100 mass % or less of the polyurethane relative to the total amount of the binder resin.

The undercoat layer may contain various additives to improve electrical properties, environmental stability, and image quality.

Examples of the additives include known materials such as electron transporting pigments based on polycyclic condensed materials and azo materials, zirconium chelate compounds, titanium chelate compounds, aluminum chelate compounds, titanium alkoxide compounds, organic titanium compounds, and silane coupling agents. The silane coupling agent is used to surface-treat the metal oxide particles as mentioned above, but may be further added as an additive to the undercoat layer.

Examples of the silane coupling agent used as an additive include vinyltrimethoxysilane, 3-methacryloxypropyl-tris(2-methoxyethoxy)silane, 2-(3,4-epoxycyclohexyl) ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanol aminate, and polyhydroxy titanium stearate.

Examples of the aluminum chelate compounds include aluminum isopropylate, monobutoxyaluminum diisopropylate, aluminum butylate, diethylacetoacetate aluminum diisopropylate, and aluminum tris(ethylacetoacetate).

These additives may be used alone, or two or more compounds may be used as a mixture or a polycondensation product.

From the viewpoint of suppressing the increase in residual potential caused by repeated image formation, the thickness of the undercoat layer is preferably 1 μm or more, more preferably 2 μm or more, and yet more preferably 3 μm or more. The thickness of the undercoat layer is preferably 10

μm or less, more preferably 9 μm or less, and yet more preferably 8 μm or less from the viewpoint obtaining a photoreceptor having an excellent charge-retaining property.

The volume resistivity of the undercoat layer may be $1\times10^{10}$ Ωcm or more and $1\times10^{12}$ Ωcm or less.

The undercoat layer may have a Vickers hardness of 35 or more.

In order to suppress moire images, the surface roughness (ten-point average roughness) of the undercoat layer may be adjusted to be in the range of 1/(4n) (n represents the refractive index of the overlying layer) to ½ of λ representing the laser wavelength used for exposure.

In order to adjust the surface roughness, resin particles and the like may be added to the undercoat layer. Examples of the resin particles include silicone resin particles and crosslinking polymethyl methacrylate resin particles. The surface of the undercoat layer may be polished to adjust the surface roughness. Examples of the polishing method included buff polishing, sand blasting, wet honing, and grinding.

The undercoat layer may be formed by any known method. For example, a coating film is formed by using an undercoat-layer-forming solution prepared by adding the above-mentioned components to a solvent, dried, and, if needed, heated.

Examples of the solvent used for preparing the undercoat-layer-forming solution include known organic solvents, such as alcohol solvents, aromatic hydrocarbon solvents, halogenated hydrocarbon solvents, ketone solvents, ketone alcohol solvents, ether solvents, and ester solvents.

Specific examples of the solvent include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Since the perinone compound (1) and the perinone compound (2) are sparingly soluble in organic solvents, they may be dispersed in organic solvents. Examples of the dispersing method include known methods that use a roll mill, a ball mill, a vibrating ball mill, an attritor, a sand mill, a colloid mill, and a paint shaker. The metal oxide particles may also be dispersed in an organic solvent by the same dispersing method.

Examples of the method for applying the undercoat-layer-forming solution to the conductive substrate include common methods such as a blade coating method, a wire bar coating method, a spray coating method, a dip coating method, a bead coating method, an air knife coating method, and a curtain coating method.

Conductive Substrate

Examples of the conductive substrate include metal plates, metal drums, and metal belts that contain metals (aluminum, copper, zinc, chromium, nickel, molybdenum, vanadium, indium, gold, platinum, etc.) or alloys (stainless steel etc.). Other examples of the conductive substrate include paper sheets, resin films, and belts coated, vapor-deposited, or laminated with conductive compounds (for example, conductive polymers and indium oxide), metals (for example, aluminum, palladium, and gold), or alloys. Here, "conductive" means having a volume resistivity of less than $1\times10^{13}$ Ωcm.

The surface of the conductive substrate may be roughened to a center-line average roughness Ra of 0.04 μm or more and 0.5 μm or less in order to suppress interference fringes that occur when the electrophotographic photoreceptor used in a laser printer is irradiated with a laser beam. When incoherent light is used as a light source, there is no need to roughen the surface to prevent interference fringes, but roughening the surface suppresses generation of defects due to irregularities on the surface of the conductive substrate and thus is desirable for extending the lifetime.

Examples of the surface roughening method include a wet honing method with which an abrasive suspended in water is sprayed onto a conductive support, a centerless grinding with which a conductive substrate is pressed against a rotating grinding stone to perform continuous grinding, and an anodization treatment.

Another example of the surface roughening method does not involve roughening the surface of a conductive substrate but involves dispersing a conductive or semi-conductive powder in a resin and forming a layer of the resin on a surface of a conductive substrate so as to create a rough surface by the particles dispersed in the layer.

The surface roughening treatment by anodization involves forming an oxide film on the surface of a conductive substrate by anodization by using a metal (for example, aluminum) conductive substrate as the anode in an electrolyte solution. Examples of the electrolyte solution include a sulfuric acid solution and an oxalic acid solution. However, a porous anodization film formed by anodization is chemically active as is, is prone to contamination, and has resistivity that significantly varies depending on the environment. Thus, a pore-sealing treatment may be performed on the porous anodization film so as to seal fine pores in the oxide film by volume expansion caused by hydrating reaction in pressurized steam or boiling water (a metal salt such as a nickel salt may be added) so that the oxide is converted into a more stable hydrous oxide.

The thickness of the anodization film may be, for example, 0.3 μm or more and 15 μm or less. When the thickness is within this range, a barrier property against injection tends to be exhibited, and the increase in residual potential caused by repeated use tends to be suppressed.

The conductive substrate may be subjected to a treatment with an acidic treatment solution or a Boehmite treatment.

The treatment with an acidic treatment solution is, for example, conducted as follows. First, an acidic treatment solution containing phosphoric acid, chromic acid, and hydrofluoric acid is prepared. The blend ratios of phosphoric acid, chromic acid, and hydrofluoric acid in the acidic treatment solution may be, for example, in the range of 10 mass % or more and 11 mass % or less for phosphoric acid, in the range of 3 mass % or more and 5 mass % or less for chromic acid, and in the range of 0.5 mass % or more and 2 mass % or less for hydrofluoric acid; and the total concentration of these acids may be in the range of 13.5 mass % or more and 18 mass % or less. The treatment temperature may be, for example, 42° C. or more and 48° C. or less. The thickness of the film may be 0.3 μm or more and 15 μm or less.

The Boehmite treatment is conducted by immersing a conductive substrate in pure water at 90° C. or higher and 100° C. or lower for 5 to 60 minutes or by bringing a conductive substrate into contact with pressurized steam at 90° C. or higher and 120° C. or lower for 5 to 60 minutes. The thickness of the film may be 0.1 μm or more and 5 μm or less.

The Boehmite-treated body may be further anodized by using an electrolyte solution, such as adipic acid, boric acid, a borate salt, a phosphate salt, a phthalate salt, a maleate salt, a benzoate salt, a tartrate salt, or a citrate salt, that has low film-dissolving power.

Intermediate Layer

Although not illustrated in the drawings, an intermediate layer may be further provided between the undercoat layer and the photosensitive layer.

The intermediate layer is, for example, a layer that contains a resin. Examples of the resin used in the intermediate layer include polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may contain an organic metal compound. Examples of the organic metal compound used in the intermediate layer include organic metal compounds containing metal atoms such as zirconium, titanium, aluminum, manganese, and silicon.

These compounds used in the intermediate layer may be used alone, or two or more compounds may be used as a mixture or a polycondensation product.

In particular, the intermediate layer may be a layer that contains an organic metal compound that contains zirconium atoms or silicon atoms.

The intermediate layer may be formed by any known method. For example, a coating film is formed by using an intermediate-layer-forming solution prepared by adding the above-mentioned components to a solvent, dried, and, if needed, heated.

Examples of the application method for forming the intermediate layer include common methods such as a dip coating method, a lift coating method, a wire bar coating method, a spray coating method, a blade coating method, a knife coating method, and a curtain coating method.

The thickness of the intermediate layer may be set within the range of, for example, 0.1 μm or more and 3 μm or less.

Charge Generating Layer

The charge generating layer is, for example, a layer that contains a charge generating material and a binder resin. The charge generating layer may be a vapor deposited layer of a charge generating material. The vapor deposited layer of the charge generating material may be used when an incoherent light such as a light emitting diode (LED) or an organic electro-luminescence (EL) image array is used.

Examples of the charge generating material include azo pigments such as bisazo and trisazo pigments; fused-ring aromatic pigments such as dibromoanthanthrone; perylene pigments; pyrrolopyrrole pigments; phthalocyanine pigments; zinc oxide; and trigonal selenium.

Among these, in order to be compatible to the near-infrared laser exposure, a metal phthalocyanine pigment or a metal-free phthalocyanine pigment may be used as the charge generating material. Specific examples thereof include hydroxygallium phthalocyanine, chlorogallium phthalocyanine, dichlorotin phthalocyanine and titanyl phthalocyanine.

In order to be compatible to the near ultraviolet laser exposure, the charge generating material may be a fused-ring aromatic pigment such as dibromoanthanthrone, a thioindigo pigment, a porphyrazine compound, zinc oxide, trigonal selenium, a bisazo pigment or the like.

When an incoherent light source, such as an LED or an organic EL image array having an emission center wavelength in the range of 450 nm or more and 780 nm or less, is used, the charge generating material described above may be used; however, from the viewpoint of the resolution, when the photosensitive layer is as thin as 20 μm or less, the electric field intensity in the photosensitive layer is increased, charges injected from the substrate are decreased, and image defects known as black spots tend to occur. This is particularly noticeable when a charge generating material, such as trigonal selenium or a phthalocyanine pigment, that is of a p-conductivity type and easily generates dark current is used.

In contrast, when an n-type semiconductor, such as a fused-ring aromatic pigment, a perylene pigment, or an azo pigment, is used as the charge generating material, dark current rarely occurs and, even when the thickness is small, image defects known as black spots can be suppressed. Examples of the n-type charge generating material include, but are not limited to, compounds (CG-1) to (CG-27).

Whether n-type or not is determined by a time-of-flight method commonly employed and on the basis of the polarity of the photocurrent flowing therein. A material in which electrons flow more smoothly as carriers than holes is determined to be of an n-type.

The binder resin used in the charge generating layer is selected from a wide range of insulating resins. Alternatively, the binder resin may be selected from organic photoconductive polymers, such as poly-N-vinylcarbazole, polyvinyl anthracene, polyvinyl pyrene, and polysilane.

Examples of the binder resin include, polyvinyl butyral resins, polyarylate resins (polycondensates of bisphenols and aromatic dicarboxylic acids etc.), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. Here, "insulating" means having a volume resistivity of $10^{13}$ Ωcm or more.

These binder resins are used alone or in combination as a mixture.

The blend ratio of the charge generating material to the binder resin may be in the range of 10:1 to 1:10 on a mass ratio basis.

The charge generating layer may contain other known additives.

The charge generating layer may be formed by any known method. For example, a coating film is formed by using an charge-generating-layer-forming solution prepared by adding the above-mentioned components to a solvent, dried, and, if needed, heated. The charge generating layer may be formed by vapor-depositing a charge generating material. The charge generating layer may be formed by vapor deposition particularly when a fused-ring aromatic pigment or a perylene pigment is used as the charge generating material.

Specific examples of the solvent for preparing the charge-generating-layer-forming solution include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents are used alone or in combination as a mixture.

In order to disperse particles (for example, the charge generating material) in the charge-generating-layer-forming solution, a media disperser such as a ball mill, a vibrating ball mill, an attritor, a sand mill, or a horizontal sand mill, or a media-less disperser such as stirrer, an ultrasonic disperser, a roll mill, or a high-pressure homogenizer can be used. Examples of the high-pressure homogenizer include a collision-type homogenizer in which the dispersion in a high-pressure state is dispersed through liquid-liquid collision or liquid-wall collision, and a penetration-type homogenizer in which the fluid in a high-pressure state is caused to penetrate through fine channels.

In dispersing, it is effective to set the average particle diameter of the charge generating material in the charge-generating-layer-forming solution to 0.5 μm or less, preferably 0.3 μm or less, and more preferably 0.15 μm or less.

Examples of the method for applying the charge-generating-layer-forming solution to the undercoat layer (or the intermediate layer) include common methods such as a blade coating method, a wire bar coating method, a spray coating method, a dip coating method, a bead coating method, an air knife coating method, and a curtain coating method.

The thickness of the charge generating layer is preferably set within the range of, for example, 0.1 μm or more and 5.0 μm or less, and more preferably within the range of 0.2 μm or more and 2.0 μm or less.

Charge Transporting Layer

The charge transporting layer is, for example, a layer that contains a charge transporting material and a binder resin. The charge transporting layer may be a layer that contains a polymer charge transporting material.

Examples of the charge transporting material include electron transporting compounds such as quinone compounds such as p-benzoquinone, chloranil, bromanil, and anthraquinone; tetracyanoquinodimethane compounds; fluorenone compounds such as 2,4,7-trinitrofluorenone; xanthone compounds; benzophenone compounds; cyanovinyl compounds; and ethylene compounds. Other examples of the charge transporting material include hole transporting compounds such as triarylamine compounds, benzidine compounds, aryl alkane compounds, aryl-substituted ethylene compounds, stilbene compounds, anthracene compounds, and hydrazone compounds. These charge transporting materials may be used alone or in combination, but are not limiting.

From the viewpoint of charge mobility, the charge transporting material may be a triaryl amine derivative represented by structural formula (a-1) below or a benzidine derivative represented by structural formula (a-2) below.

(a-1)

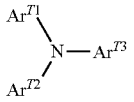

In structural formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituent for each of the groups described above include a halogen atom, an alkyl group having 1 to 5 carbon atoms, and an alkoxy group having 1 to 5 carbon atoms. Examples of the substituent for each of the groups described above include a substituted amino group substituted with an alkyl group having 1 to 3 carbon atoms.

(a-2)

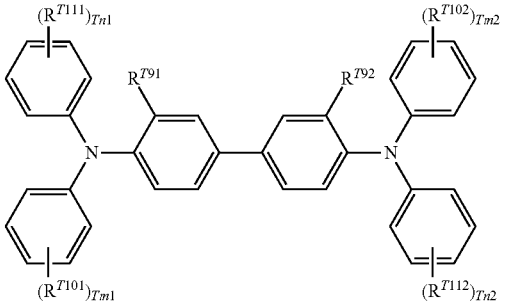

In structural formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $T^{111}$, and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{T12})=C(R^{T13})(R^{T14})$, or $—CH=CH—CH=C(R^{T15})(R^{T16})$; and $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer of 0 or more and 2 or less.

Examples of the substituent for each of the groups described above include a halogen atom, an alkyl group having 1 to 5 carbon atoms, and an alkoxy group having 1 to 5 carbon atoms. Examples of the substituent for each of the groups described above include a substituted amino group substituted with an alkyl group having 1 to 3 carbon atoms.

Here, among the triarylamine derivatives represented by structural formula (a-1) and the benzidine derivatives represented by structural formula (a-2) above, a triarylamine derivative having $—C_6H_4—CH=CH—CH=C(R^{T7})(R^{T8})$ or a benzidine derivative having $—CH=CH—CH=C(R^{T15})(R^{T16})$ may be used from the viewpoint of the charge mobility.

Examples of the polymer charge transporting material that can be used include known charge transporting materials such as poly-N-vinylcarbazole and polysilane. In particular, polyester polymer charge transporting materials are particularly preferable. The polymer charge transporting material may be used alone or in combination with a binder resin.

Examples of the binder resin used in the charge transporting layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, a polycarbonate resin or a polyarylate resin may be used as the binder resin. These binder resins are used alone or in combination.

The blend ratio of the charge transporting material to the binder resin may be in the range of 10:1 to 1:5 on a mass ratio basis.

The charge transporting layer may contain other known additives.

The charge transporting layer may be formed by any known method. For example, a coating film is formed by using a charge-transporting-layer-forming solution prepared by adding the above-mentioned components to a solvent, dried, and, if needed, heated.

Examples of the solvent used to prepare the charge-transporting-layer-forming solution include common organic solvents such as aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. These solvents are used alone or in combination as a mixture.

Examples of the method for applying the charge-transporting-layer-forming solution to the charge generating layer include common methods such as a blade coating method, a wire bar coating method, a spray coating method, a dip coating method, a bead coating method, an air knife coating method, and a curtain coating method.

The thickness of the charge transporting layer is preferably set within the range of, for example, 5 μm or more and 50 μm or less, and more preferably within the range of 10 μm or more and 30 μm or less.

Protective Layer

A protective layer is disposed on a photosensitive layer if necessary. The protective layer is, for example, formed to avoid chemical changes in the photosensitive layer during charging and further improve the mechanical strength of the photosensitive layer.

Thus, the protective layer may be a layer formed of a cured film (crosslinked film). Examples of such a layer include layers indicated in 1) and 2) below.

1) A layer formed of a cured film of a composition that contains a reactive-group-containing charge transporting material having a reactive group and a charge transporting skeleton in the same molecule (in other words, a layer that contains a polymer or crosslinked body of the reactive-group-containing charge transporting material).

2) A layer formed of a cured film of a composition that contains a non-reactive charge transporting material, and a reactive-group-containing non-charge transporting material that does not have a charge transporting skeleton but has a reactive group (in other words, a layer that contains a polymer or crosslinked body of the non-reactive charge transporting material and the reactive-group-containing non-charge transporting material).

Examples of the reactive group contained in the reactive-group-containing charge transporting material include chain-polymerizable groups, an epoxy group, —OH, —OR (where R represents an alkyl group), —$NH_2$, —SH, —COOH, and —$SiR^{Q1}{}_{3-Qn}(OR^{Q2})_{Qn}$ (where $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer of 1 to 3).

The chain-polymerizable group may be any radical-polymerizable functional group, and an example thereof is a functional group having a group that contains at least a carbon-carbon double bond. A specific example thereof is a group that contains at least one selected from a vinyl group, a vinyl ether group, a vinyl thioether group, a styryl group (vinylphenyl group), an acryloyl group, a methacryloyl group, and derivatives thereof. Among these, the chain-polymerizable group may be a group that contains at least one selected from a vinyl group, a vinylphenyl group, an acryloyl group, a methacryloyl group, and derivatives thereof due to their excellent reactivity.

The charge transporting skeleton of the reactive-group-containing charge transporting material may be any known structure used in the electrophotographic photoreceptor, and examples thereof include skeletons that are derived from nitrogen-containing hole transporting compounds, such as triarylamine compounds, benzidine compounds, and hydrazone compounds, and that are conjugated with nitrogen atoms. Among these, a triarylamine skeleton is preferable.

The reactive-group-containing charge transporting material that has such a reactive group and a charge transporting skeleton, the non-reactive charge transporting material, and the reactive-group-containing non-charge transporting material may be selected from among known materials.

The protective layer may contain other known additives.

The protective layer may be formed by any known method. For example, a coating film is formed by using a protective-layer-forming solution prepared by adding the above-mentioned components to a solvent, dried, and, if needed, cured such as by heating.

Examples of the solvent used to prepare the protective-layer-forming solution include aromatic solvents such as toluene and xylene, ketone solvents such as methyl ethyl ketone, methyl isobutyl ketone, and cyclohexanone, ester solvents such as ethyl acetate and butyl acetate, ether solvents such as tetrahydrofuran and dioxane, cellosolve solvents such as ethylene glycol monomethyl ether, and alcohol solvents such as isopropyl alcohol and butanol. These solvents are used alone or in combination as a mixture.

The protective-layer-forming solution may be a solvent-free solution.

Examples of the application method used to apply the protective-layer-forming solution onto the photosensitive layer (for example, the charge transporting layer) include common methods such as a dip coating method, a lift coating method, a wire bar coating method, a spray coating method, a blade coating method, a knife coating method, and a curtain coating method.

The thickness of the protective layer is preferably set within the range of, for example, 1 μm or more and 20 μm or less, and more preferably within the range of 2 μm or more and 10 μm or less.

Single-Layer-Type Photosensitive Layer

The single-layer-type photosensitive layer (charge generating/charge transporting layer) is, for example, a layer that contains a charge generating material, a charge transporting material, and, optionally, a binder resin and other known additives. These materials are the same as those described in relation to the charge generating layer and the charge transporting layer.

The amount of the charge generating material contained in the single-layer-type photosensitive layer relative to the total solid content may be 0.1 mass % or more and 10 mass % or less, and is preferably 0.8 mass % or more and 5 mass % or less. The amount of the charge transporting material contained in the single-layer-type photosensitive layer relative to the total solid content may be 5 mass % or more and 50 mass % or less.

The method for forming the single-layer-type photosensitive layer is the same as the method for forming the charge generating layer and the charge transporting layer.

The thickness of the single-layer-type photosensitive layer may be, for example, 5 μm or more and 50 μm or less, and is preferably 10 μm or more and 40 μm or less.

Image Forming Apparatus and Process Cartridge

An image forming apparatus of an exemplary embodiment includes an electrophotographic photoreceptor, a charging unit that charges a surface of the electrophotographic photoreceptor, an electrostatic latent image forming unit that forms an electrostatic latent image on the charged surface of the electrophotographic photoreceptor, a developing unit that develops the electrostatic latent image on the surface of the electrophotographic photoreceptor by using a developer that contains a toner so as to form a toner image, and a transfer unit that transfers the toner image onto a surface of a recording medium. The electrophotographic photoreceptor of the exemplary embodiment described above is used as the electrophotographic photoreceptor.

The image forming apparatus of the exemplary embodiment is applied to a known image forming apparatus, examples of which include an apparatus equipped with a fixing unit that fixes the toner image transferred onto the surface of the recording medium; a direct transfer type apparatus with which the toner image formed on the surface of the electrophotographic photoreceptor is directly transferred to the recording medium; an intermediate transfer type apparatus with which the toner image formed on the surface of the electrophotographic photoreceptor is first transferred to a surface of an intermediate transfer body and then the toner image on the surface of the intermediate transfer body is transferred to the surface of the recording medium; an apparatus equipped with a cleaning unit that cleans the surface of the electrophotographic photoreceptor after the toner image transfer and before charging; an apparatus equipped with a charge erasing unit that erases the charges on the surface of the electrophotographic photoreceptor by applying the charge erasing light after the toner image transfer and before charging; and an apparatus equipped with an electrophotographic photoreceptor heating member that elevates the temperature of the electrophotographic photoreceptor to reduce the relative temperature.

In the intermediate transfer type apparatus, the transfer unit includes, for example, an intermediate transfer body having a surface onto which a toner image is to be transferred, a first transfer unit that conducts first transfer of the toner image on the surface of the electrophotographic photoreceptor onto the surface of the intermediate transfer body, and a second transfer unit that conducts second transfer of the toner image on the surface of the intermediate transfer body onto a surface of a recording medium.

The image forming apparatus of this exemplary embodiment may be of a dry development type or a wet development type (development type that uses a liquid developer).

In the image forming apparatus of the exemplary embodiment, for example, a section that includes the electrophotographic photoreceptor may be configured as a cartridge structure (process cartridge) detachably attachable to the image forming apparatus. A process cartridge equipped with the electrophotographic photoreceptor of the exemplary embodiment may be used as this process cartridge. The process cartridge may include, in addition to the electrophotographic photoreceptor, at least one selected from the group consisting of a charging unit, an electrostatic latent image forming unit, a developing unit, and a transfer unit.

Although some examples of the image forming apparatus of an exemplary embodiment are described below, these examples are not limiting. Only relevant sections illustrated in the drawings are described, and descriptions of other sections are omitted.

Figure 2:
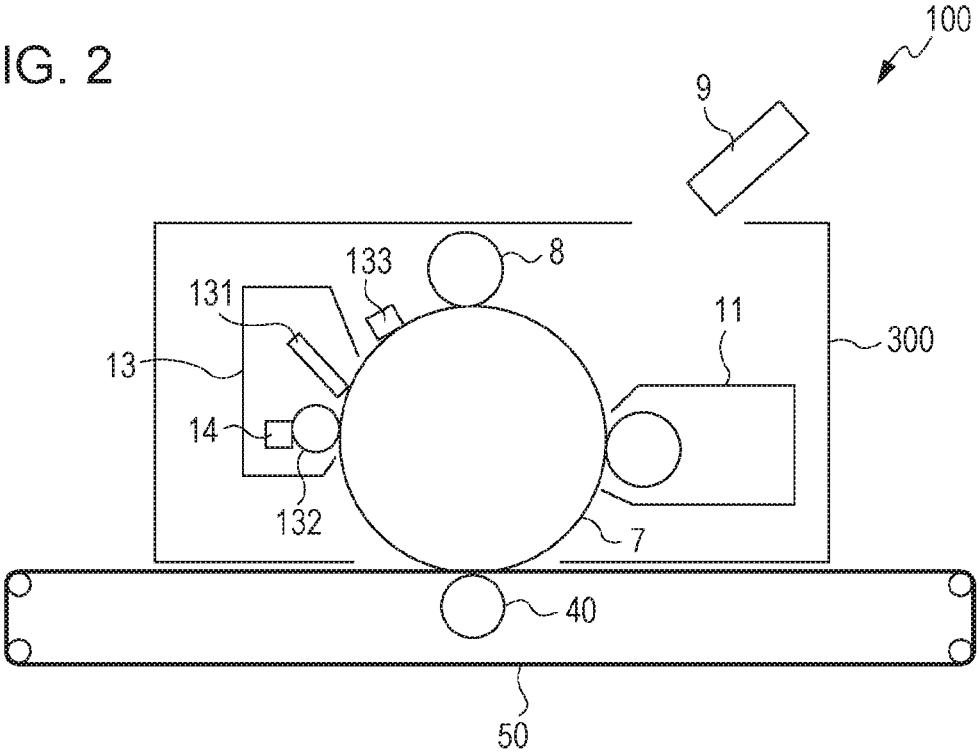
FIG. 2 is a schematic diagram illustrating one example of an image forming apparatus according to an exemplary embodiment.

FIG. 2 is a schematic diagram illustrating one example of an image forming apparatus according to an exemplary embodiment;

As illustrated in FIG. 2, an image forming apparatus 100 of this exemplary embodiment includes a process cartridge 300 equipped with an electrophotographic photoreceptor 7, an exposing device 9 (one example of the electrostatic latent image forming unit), a transfer device 40 (first transfer device), and an intermediate transfer body 50. In this image forming apparatus 100, an exposing device 9 is positioned so that light can be applied to the electrophotographic photoreceptor 7 from the opening of the process cartridge 300, the transfer device 40 is positioned to oppose the electrophotographic photoreceptor 7 with the intermediate transfer body 50 therebetween, and the intermediate transfer body 50 has a portion in contact with the electrophotographic photoreceptor 7. Although not illustrated in the drawings, a second transfer device that transfers the toner image on the intermediate transfer body 50 onto a recording medium (for example, a paper sheet) is also provided. The intermediate transfer body 50, the transfer device 40 (first transfer device), and the second transfer device (not illustrated) correspond to examples of the transfer unit.

The process cartridge 300 illustrated in FIG. 2 integrates and supports the electrophotographic photoreceptor 7, a charging device 8 (one example of the charging unit), a developing device 11 (one example of the developing unit), and a cleaning device 13 (one example of the cleaning unit) in the housing. The cleaning device 13 has a cleaning blade (one example of the cleaning member) 131, and the cleaning blade 131 is in contact with the surface of the electrophotographic photoreceptor 7. The cleaning member may take a form other than the cleaning blade 131, and may be a conductive or insulating fibrous member that can be used alone or in combination with the cleaning blade 131.

Although an example of the image forming apparatus equipped with a fibrous member 132 (roll) that supplies a lubricant 14 to the surface of the electrophotographic photoreceptor 7 and a fibrous member 133 (flat brush) that assists cleaning is illustrated in FIG. 2, these members are optional.

The features of the image forming apparatus of this exemplary embodiment will now be described.

Charging Device

Examples of the charging device 8 include contact-type chargers that use conductive or semi-conducting charging rollers, charging brushes, charging films, charging rubber blades, and charging tubes. Known chargers such as non-contact-type roller chargers, and scorotron chargers and corotron chargers that utilize corona discharge are also used.

Exposing Device

Examples of the exposing device 9 include optical devices that can apply light, such as semiconductor laser light, LED light, or liquid crystal shutter light, into a particular image shape onto the surface of the electrophotographic photoreceptor 7. The wavelength of the light source is to be within the spectral sensitivity range of the electrophotographic photoreceptor. The mainstream wavelength of the semiconductor lasers is near infrared having an oscillation wavelength at about 780 nm. However, the wavelength is not limited to this, and a laser having an oscillation wavelength on the order of 600 nm or a blue laser having an oscillation wavelength of 400 nm or more and 450 nm or less may be used. In order to form a color image, a surface-emitting laser light source that can output multi beams is also effective.

Developing Device

Examples of the developing device 11 include common developing devices that perform development by using a developer in contact or non-contact manner. The developing device 11 is not particularly limited as long as the aforementioned functions are exhibited, and is selected according to the purpose. An example thereof is a known developer that has a function of attaching a one-component developer or a two-component developer to the electrophotographic photoreceptor 7 by using a brush, a roller, or the like. In particular, a development roller that retains the developer on its surface may be used.

The developer used in the developing device 11 may be a one-component developer that contains only a toner or a two-component developer that contains a toner and a carrier. The developer may be magnetic or non-magnetic. Any known developers may be used as these developers.

Cleaning Device

A cleaning blade type device equipped with a cleaning blade 131 is used as the cleaning device 13.

Instead of the cleaning blade type, a fur brush cleaning type device or a development-cleaning simultaneous type device may be employed.

Transfer Device

Examples of the transfer device 40 include contact-type transfer chargers that use belts, rollers, films, rubber blades, etc., and known transfer chargers such as scorotron transfer chargers and corotron transfer chargers that utilize corona discharge.

Intermediate Transfer Body

A belt-shaped member (intermediate transfer belt) that contains semi-conducting polyimide, polyamide imide, polycarbonate, polyarylate, a polyester, a rubber or the like is used as the intermediate transfer body 50. The form of the intermediate transfer body other than the belt may be a drum.

Figure 3:
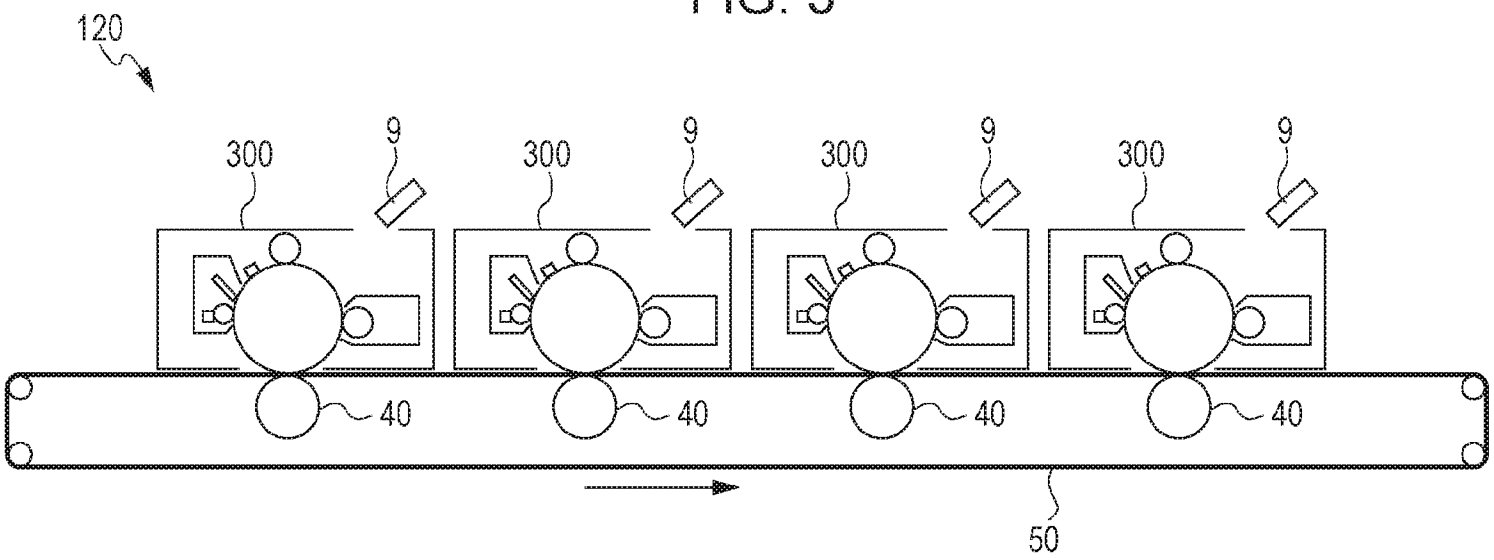
FIG. 3 is a schematic diagram illustrating another example of the image forming apparatus according to the exemplary embodiment.

FIG. 3 is a schematic diagram illustrating another example of the image forming apparatus according to the exemplary embodiment.

An image forming apparatus 120 illustrated in FIG. 3 is a tandem-system multicolor image forming apparatus equipped with four process cartridges 300. In the image forming apparatus 120, four process cartridges 300 are arranged in parallel on the intermediate transfer body 50, and one electrophotographic photoreceptor is used for one color. The image forming apparatus 120 is identical to the image forming apparatus 100 except for the tandem system.

EXAMPLES

The electrophotographic photoreceptor of the present disclosure will now be described more specifically through examples below. The materials, the amounts thereof used, the ratios, the treatment procedure, and the like of the examples described below are subject to modification and alteration without departing from the gist of the present disclosure. Thus, the interpretation of the scope of the electrophotographic photoreceptor of the present disclosure is not to be limited by the specific examples described below.

Preparation of Photoreceptor

Example 1

Formation of Undercoat Layer

In 143 parts by mass of methyl ethyl ketone, 21 parts by mass of a blocked isocyanate (Sumidur BL3175 produced by Sumitomo Bayer Urethane Co., Ltd., solid content: 75 mass %), 9 parts by mass of a butyral resin (S-LEC BL-1 produced by Sekisui Chemical Co., Ltd.), and 0.005 parts by mass of dioctyltin dilaurate serving as a urethane-curing catalyst are dissolved. To the resulting solution, 50 parts by mass of a mixture (mass ratio: 1:1) of the perinone compound (1-3) and the perinone compound (2-3) and 20 parts by mass of alumina particles (produced by EM Japan Co., Ltd., average primary particle diameter: 200 nm) are mixed, and the resulting mixture is dispersed for 120 minutes in a sand mill using glass beads having a diameter of 1 mm so as to obtain an undercoat layer-forming solution. The solution is applied to a cylindrical aluminum substrate by dip coating, and dried and cured at 160° C. for 60 minutes so as to form an undercoat layer having a thickness of 5.0 μm.

Formation of Charge Generating Layer

Hydroxygallium phthalocyanine having diffraction peaks at least at Bragg's angles (2θ±0.2°) of 7.3°, 16.0°, 24.9°, and 28.0° in an X-ray diffraction spectrum obtained by using CuK α X-ray is prepared as the charge generating material.

A mixture containing 15 parts by mass of hydroxygallium phthalocyanine, 10 parts by mass of a vinyl chloride-vinyl acetate copolymer resin (VMCH produced by Nippon Unicar Company Limited), and 200 parts by mass of n-butyl acetate is dispersed for 4 hours in a sand mill using glass beads having a diameter of 1 mm. To the resulting dispersion, 175 parts by mass of n-butyl acetate and 180 parts by mass of methyl ethyl ketone are added and stirred so as to obtain a charge-generating-layer-forming solution. The solution is applied to the undercoat layer by dip-coating, and dried at room temperature (25° C.) to form a charge generating layer having a thickness of 0.2 μm.

Formation of Charge Transporting Layer

Into a flask equipped with a phosgene blowing tube, a thermometer, and a stirrer, 106.9 g (0.398 mol) of 1,1-bis(4-hydroxyphenyl)cyclohexane (hereinafter referred to as Z), 24.7 g (0.133 mol) of 4,4'-dihydroxybiphenyl (hereinafter referred to as BP), 0.41 g of hydrosulfite, 825 ml of a 9.1% aqueous sodium hydroxide solution (sodium hydroxide: 2.018 mol), and 500 ml of methylene chloride are charged in a nitrogen atmosphere and dissolved. The resulting mixture is retained at 18° C. to 21° C. under stirring, and 76.2 g (0.770 mol) of phosgene is blown in 75 minutes to induce phosgene reaction. Upon completion of the phosgene reaction, 1.11 g (0.0075 mol) of p-tert-butylphenol and 54 ml (sodium hydroxide: 0.266 mol) of a 25% aqueous sodium hydroxide solution are added thereto. The resulting mixture is stirred, during which 0.18 mL (0.0013 mol) of triethylamine is added, and the reaction is performed at a temperature of 30° C. to 35° C. for 2.5 hours. The separated methylene chloride phase is washed with an acid and washed with water until inorganic salts and amines are eliminated, and then methylene chloride is removed to obtain a polycarbonate copolymer (1). The polycarbonate copolymer (1) has a Z-to-BP constitutional unit molar ratio of 75:25 and has a viscosity-average molecular weight of 50,000.

To 560 parts by mass of tetrahydrofuran and 240 parts by mass of toluene, 25 parts by mass of N,N'-diphenyl-N,N'-bis(3-methylphenyl)-[1,1']biphenyl-4,4'-diamine (TPD), 20 parts by mass of a compound represented by structural formula (A) below, and 55 parts by mass of the polycarbonate copolymer (1) serving as a binder resin are added and dissolved so as to obtain a charge transporting layer-forming solution. The solution is applied to the charge generating layer and dried at 135° C. for 45 minutes to form a charge transporting layer having a thickness of 22 μm. A photoreceptor of Example 1 is obtained through such a process.

Structural formula (A)

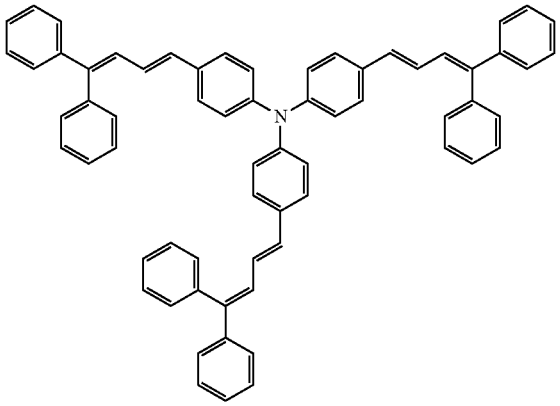

Examples 2 to 17

Photoreceptors are prepared as in Example 1 except that, in forming the undercoat layer, the type and the added amount of the perinone compounds, the type and the added amount of the metal oxide particles, or the thickness of the undercoat layer is changed as indicated in Table.

The iron oxide particles used in Example 2 have an average primary particle diameter of 250 nm (produced by COREFRONT Corporation).

The copper oxide particles used in Example 3 have an average primary particle diameter of 100 nm (produced by JAPAN-ION Corporation).

The magnesium oxide particles used in Example 4 have an average primary particle diameter of 100 nm (produced by Ion Ceramic Corporation).

The calcium oxide particles used in Example 5 have an average primary particle diameter of 150 nm (produced by OMI MINING Co., LTD.).

The silica particles used in Example 6 have an average primary particle diameter of 200 nm (produced by COREFRONT Corporation).

Example 18

A photoreceptor is prepared as in Example 1 except that, in forming the undercoat layer, the binder resin is changed from polyurethane to polyethylene (NEO-ZEX produced by Prime Polymer Co., Ltd.).

Comparative Examples 1 to 3 (Indicated as "C.E.1" to "C.E.3" in the Table)

Photoreceptors are prepared as in Example 1 except that, in forming the undercoat layer, the perinone compound is changed to the imide compound indicated in Table. The chemical structures of an imide compound (A), an imide compound (B), and an imide compound (C) used in Comparative Examples 1 to 3 are as follows.

Imide compound (A)

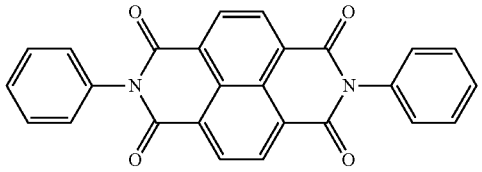

Imide compound (B)

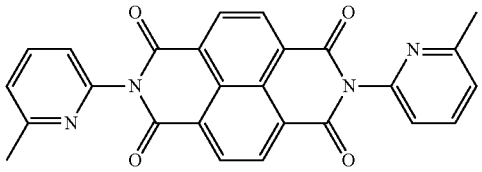

Imide compound (C)

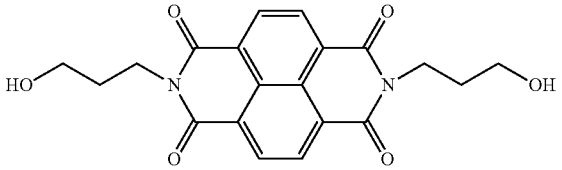

Comparative Example 4 (Indicated as "C.E.4" in the Table)

A photoreceptor is prepared as in Example 1 except that, in forming the undercoat layer, the metal oxide particles are not used.

Comparative Example 5 (Indicated as "C.E.5" in the Table)

A photoreceptor is prepared as in Example 1 except that the thickness of the undercoat layer is changed as indicated in Table.

Comparative Examples 6 to 9 (Indicated as "C.E.6" to "C.E.9" in the Table)

Photoreceptors are prepared as in Example 1 except that, in forming the undercoat layer, the metal oxide particles are changed to other particles as indicated in Table.

The zinc oxide particles used in Comparative Example 6 are particles obtained by surface-treating untreated zinc oxide particles (average primary particle diameter: 70 nm, MZ-150 produced by Tayca Corporation) with a silane coupling agent (KBE-502, 3-methacryloxypropylmethyldiethoxysilane produced by Shin-Etsu Chemical Co., Ltd.).

The titanium oxide particles used in Comparative Example 7 have an average primary particle diameter of 30 nm (TAF-1500) produced by FUJI TITANIUM INDUSTRY CO., LTD.).

The tin oxide particles used in Comparative Example 8 have an average primary particle diameter of 20 nm (S1 produced by Mitsubishi Materials Corporation).

The iron particles used in Comparative Example 9 have an average primary particle diameter of 100 nm (produced by JFE Steel Corporation).

Performance Evaluation of Photoreceptors

The photoreceptors of Examples and Comparative Examples are each attached to an image forming apparatus produced by Fuji Xerox Co., Ltd., Docucentre-V C7775, and the following performance evaluation is carried out in an environment having a temperature of 40° C. and a relative humidity of 90%. The results are indicated in Table.

Charge-Retaining Property

A surface potential probe of a surface potentiometer (Trek 334 produced by Trek Japan Co., Ltd.) is installed at a position 1 mm remote from the surface of the photoreceptor.

After the surface of the photoreceptor is charged to −700 V, the decrease in potential (dark decay) after 0.1 seconds is measured, and the decrease in potential is rated in four grades.

A+: The decrease in potential is less than 20 V.

A: The decrease in potential is 20 V or more but less than 25 V.

B: The decrease in potential is 25 V or more but less than 50 V.

C: The decrease in potential is 50 V or more.

Suppressing Occurrence of Leakage Current

When carbon fibers penetrate through the photosensitive layer and the undercoat layer and reach the conductive substrate, electric current flows and spot-like image defects occur. This phenomenon is utilized to evaluate suppression of occurrence of leakage current.

To a developer, 0.1 mass % of carbon fibers (average diameter: 7 μm, average length: 120 μm) relative to the amount of the developer are added, and a black image with an image density of 15% is continuously output on 30,000 sheets of A4 paper. Whether spot-like image defects are present is observed with naked eye on the image on the 30,000th sheet, and the extent of the image defects is graded from A to C as follows.

A+: Less than five spot-like image defects are found.

A: Five or more but less than ten spot-like image defects are found.

B: Ten or more but less than twenty spot-like image defects are found.

C: Twenty or more image spot-like image defects are found.

Residual Potential after Repeated Image Formation

A surface potential probe of a surface potentiometer (Trek 334 produced by Trek Japan Co., Ltd.) is installed at a position 1 mm remote from the surface of the photoreceptor.

The surface of the photoreceptor is charged to −700 V, and the residual potential after charge erasing is measured.

This measurement is performed before and after outputting an image having a density of 20% on 80,000 sheets of A4 paper, and the residual potential before output is subtracted from the residual potential after output to determine the residual potential difference. The residual potential difference between before and after output is categorized into A+ to C below.

A+: The residual potential difference between before and after output is less than 20 V.

A: The residual potential difference between before and after output is 20 V or more but less than 50 V.

B: The residual potential difference between before and after output is 50 V or more but less than 100 V.

C: The residual potential difference between before and after output is 100 V or more.

TABLE

| | Undercoat layer | | | | | | |
|---|---|---|---|---|---|---|---|
| | | | Metal oxide particles or other particles | | | | |
| | Electron transporting compound | | | | | | |
| Classification | Type | Amount [parts by mass] | Type | Average primary particle diameter [nm] | Amount [parts by mass] | Volume ratio in undercoat layer [volume %] | Mass ratio relative to perinone compound [mass %] |
| C.E. 1 | Imide compound (A) | 50 | Alumina | 200 | 20 | 20 | 40 |
| C.E. 2 | Imide compound (B) | 50 | Alumina | 200 | 20 | 20 | 40 |
| C.E. 3 | Imide compound (C) | 50 | Alumina | 200 | 20 | 20 | 40 |
| C.E. 4 | Perinone compound (1-3),(2-3) | 50 | — | — | 0 | 0 | 0 |
| C.E. 5 | Perinone compound (1-3),(2-3) | 50 | Alumina | 200 | 20 | 20 | 40 |
| C.E. 6 | Perinone compound (1-3),(2-3) | 50 | Zinc oxide particles | 70 | 20 | 15 | 40 |
| C.E. 7 | Perinone compound (1-3),(2-3) | 50 | Titanium oxide particles | 30 | 20 | 15 | 40 |
| C.E. 8 | Perinone compound (1-3),(2-3) | 50 | Tin oxide particles | 20 | 20 | 15 | 40 |
| C.E. 9 | Perinone compound (1-3),(2-3) | 50 | Iron | 100 | 20 | 15 | 40 |
| Example 1 | Perinone compound (1-3),(2-3) | 50 | Alumina | 200 | 20 | 20 | 40 |
| Example 2 | Perinone compound (1-3),(2-3) | 50 | Iron oxide | 250 | 20 | 15 | 40 |
| Example 3 | Perinone compound (1-3),(2-3) | 50 | Copper oxide | 100 | 20 | 15 | 40 |
| Example 4 | Perinone compound (1-3),(2-3) | 50 | Magnesium oxide | 100 | 20 | 20 | 40 |
| Example 5 | Perinone compound (1-3),(2-3) | 50 | Calcium oxide | 150 | 20 | 20 | 40 |
| Example 6 | Perinone compound (1-3),(2-3) | 50 | Silica | 200 | 20 | 25 | 40 |
| Example 7 | Perinone compound (1-3),(2-3) | 50 | Alumina | 200 | 15 | 14 | 30 |
| Example 8 | Perinone compound (1-3),(2-3) | 50 | Alumina | 200 | 29 | 28 | 58 |
| Example 9 | Perinone compound (1-3),(2-3) | 50 | Alumina | 200 | 35 | 34 | 70 |
| Example 10 | Perinone compound (1-3),(2-3) | 70 | Alumina | 200 | 15 | 13 | 21.4 |
| Example 11 | Perinone compound (1-3),(2-3) | 75 | Alumina | 200 | 15 | 10 | 20 |
| Example 12 | Perinone compound (1-3),(2-3) | 50 | Alumina | 200 | 20 | 20 | 40 |
| Example 13 | Perinone compound (1-3),(2-3) | 50 | Alumina | 200 | 20 | 20 | 40 |
| Example 14 | Perinone compound (1-3),(2-3) | 50 | Alumina | 200 | 20 | 20 | 40 |
| Example 15 | Perinone compound (1-5),(2-5) | 50 | Alumina | 200 | 20 | 20 | 40 |
| Example 16 | Perinone compound (1-6),(2-6) | 50 | Alumina | 200 | 20 | 20 | 40 |
| Example 17 | Perinone compound (1-7),(2-7) | 50 | Alumina | 200 | 20 | 20 | 40 |
| Example 18 | Perinone compound (1-3),(2-3) | 50 | Alumina | 200 | 20 | 20 | 40 |

TABLE-continued

| | Undercoat layer | | | Evaluation | | |
|---|---|---|---|---|---|---|
| | Binder resin | | | Charge- | | Residual potential |
| Classification | Type | Amount [parts by mass] | Layer thickness [μm] | retaining property | Suppression of leakage current | after repeated image formation |
| C.E. 1 | Polyurethane | 30 | 5.0 | C | B | B |
| C.E. 2 | Polyurethane | 30 | 5.0 | C | B | B |
| C.E. 3 | Polyurethane | 30 | 5.0 | C | B | B |
| C.E. 4 | Polyurethane | 50 | 5.0 | B | C | B |
| C.E. 5 | Polyurethane | 30 | 15.0 | C | C | B |
| C.E. 6 | Polyurethane | 30 | 5.0 | B | B | B |
| C.E. 7 | Polyurethane | 30 | 5.0 | B | B | B |
| C.E. 8 | Polyurethane | 30 | 5.0 | B | B | B |
| C.E. 9 | Polyurethane | 30 | 5.0 | C | B | B |
| Example 1 | Polyurethane | 30 | 5.0 | A+ | A+ | A |
| Example 2 | Polyurethane | 30 | 5.0 | A+ | A+ | A |
| Example 3 | Polyurethane | 30 | 5.0 | A+ | A | A+ |
| Example 4 | Polyurethane | 30 | 5.0 | A | A+ | A+ |
| Example 5 | Polyurethane | 30 | 5.0 | A | A+ | A |
| Example 6 | Polyurethane | 30 | 5.0 | A | A | A |
| Example 7 | Polyurethane | 35 | 5.0 | A+ | A | A+ |
| Example 8 | Polyurethane | 21 | 5.0 | A+ | A+ | A |
| Example 9 | Polyurethane | 15 | 5.0 | A+ | A+ | A |
| Example 10 | Polyurethane | 15 | 5.0 | A+ | A | A+ |
| Example 11 | Polyurethane | 10 | 5.0 | A | A+ | A+ |
| Example 12 | Polyurethane | 30 | 1.5 | A | A+ | A |
| Example 13 | Polyurethane | 30 | 3.0 | A+ | A+ | A |
| Example 14 | Polyurethane | 30 | 9.0 | A | A+ | A+ |
| Example 15 | Polyurethane | 30 | 5.0 | A+ | A+ | A |
| Example 16 | Polyurethane | 30 | 5.0 | A+ | A+ | A |
| Example 17 | Polyurethane | 30 | 5.0 | A | A+ | A+ |
| Example 18 | Polyethylene | 35 | 5.0 | A | A | A |

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrophotographic photoreceptor comprising:

a conductive substrate;

an undercoat layer on the conductive substrate, the undercoat layer containing a first perinone compound represented by formula (1) and a second perinone compound represented by formula (2) below, metal oxide particles of at least one type selected from the group consisting of aluminum oxide particles, iron oxide particles, copper oxide particles, magnesium oxide particles, calcium oxide particles, and silicon dioxide particles, and a binder resin, the undercoat layer having a thickness of 1 μm or more and 10 μm or less; and a photosensitive layer on the undercoat layer:

formula (1)

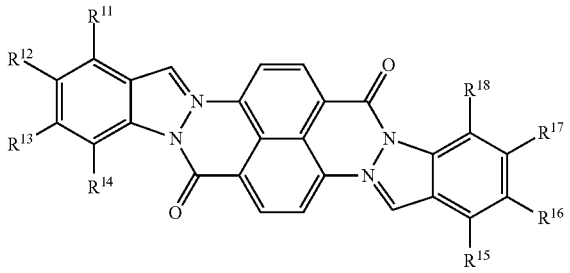

formula (2)

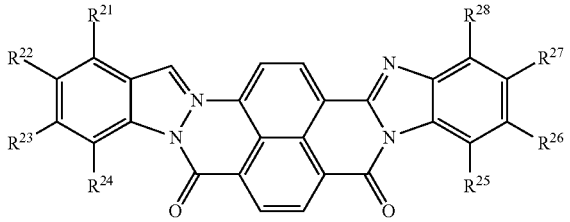

in formula (1), $R^{11}$, $R^{12}$, $R^{13}$, $R^{14}$, $R^{15}$, $R^{16}$, $R^{17}$, and $R^{18}$ each independently represent a hydrogen atom, an alkyl group, an alkoxy group, an aralkyl group, an aryl group, an aryloxy group, an alkoxycarbonyl group, an aryloxycarbonyl group, an alkoxycarbonylalkyl group, an aryloxycarbonylalkyl group, or a halogen atom; $R^{11}$ and $R^{12}$ may be bonded to each other to form a ring, so may $R^{12}$ and $R^{13}$, and so may $R^{13}$ and $R^{14}$; and $R^{15}$ and $R^{16}$ may be bonded to each other to form a ring, so may $R^{16}$ and $R^{17}$, and so may $R^{17}$ and $R^{18}$, in formula (2), $R^{21}$, $R^{22}$, $R^{23}$, $R^{24}$, $R^{25}$, $R^{26}$, $R^{27}$, and $R^{28}$ each independently represent a hydrogen atom, an alkyl group, an alkoxy group, an aralkyl group, an aryl group, an aryloxy group, an alkoxycarbonyl group, an aryloxycarbonyl group, an alkoxycarbonylalkyl group, an aryloxycarbonylalkyl group, or a halogen atom; $R^{21}$ and $R^{22}$ may be bonded to each other to form a ring, so may $R^{22}$ and $R^{23}$, and so may $R^{23}$ and $R^{24}$; and $R^{25}$ and $R^{26}$ may be bonded to each other to form a ring, so may $R^{26}$ and $R^{27}$, and so may $R^{27}$ and $R^{28}$, wherein a total amount of the first perinone compound and the second perinone compound relative to a total solid content of the undercoat layer is 50 mass % or more and 70 mass % or less, and a total content of the metal oxide particles contained in the undercoat layer relative to a total content of the first perinone compound and the second perinone compound contained in the undercoat layer is 20 mass % or more and 70 mass % or less.

2. The electrophotographic photoreceptor according to claim 1, wherein the metal oxide particles have an average primary particle diameter of 10 nm or more and 1000 nm or less.

3. The electrophotographic photoreceptor according to claim 1, wherein a total volume of the metal oxide particles in the undercoat layer is 10 vol % or more and 35 vol % or less.

4. The electrophotographic photoreceptor according to claim 1, wherein the binder resin contains polyurethane.

5. A process cartridge detachably attachable to an image forming apparatus, the process cartridge comprising the electrophotographic photoreceptor according to claim 1.

6. An image forming apparatus comprising:

the electrophotographic photoreceptor according to claim 1;

a charging unit that charges a surface of the electrophotographic photoreceptor;

an electrostatic latent image-forming unit that forms an electrostatic latent image on the charged surface of the electrophotographic photoreceptor;

a developing unit that develops the electrostatic latent image on the surface of the electrophotographic photoreceptor by using a developer containing a toner so as to form a toner image; and a transfer unit that transfers the toner image onto a surface of a recording medium.

7. The electrophotographic photoreceptor according to claim 1, wherein the undercoat layer is obtained by preparing an undercoat-layer-forming solution comprising the first perinone compound, the second perinone compound, the metal oxide particles, and the binder resin, and then coating the conductive substrate with the undercoat-layer-forming solution.

8. The electrophotographic photoreceptor according to claim 1, wherein:

in formula (1), $R^{11}$, $R^{12}$, $R^{13}$, $R^{14}$, $R^{15}$, $R^{16}$, $R^{17}$, and $R^{18}$ each independently represent a hydrogen atom, an alkyl group, an alkoxycarbonyl group, an aryloxycarbonyl group, an alkoxycarbonylalkyl group, or an aryloxycarbonylalkyl group, and in formula (2), $R^{21}$, $R^{22}$, $R^{23}$, $R^{24}$, $R^{25}$, $R^{26}$, $R^{27}$, and $R^{28}$ each independently represent a hydrogen atom, an alkyl group, an alkoxycarbonyl group, an aryloxycarbonyl group, an alkoxycarbonylalkyl group, or an aryloxycarbonylalkyl group.

9. The electrophotographic photoreceptor according to claim 1, wherein in formula (1) and formula (2), $R^{11}$ is the same as $R^{21}$, $R^{12}$ is the same as $R^{22}$, $R^{13}$ is the same as $R^{23}$, $R^{14}$ is the same as $R^{24}$, $R^{15}$ is the same as $R^{25}$, $R^{16}$ is the same as $R^{26}$, $R^{17}$ is the same as $R^{27}$ and $R^{18}$ is the same as $R^{28}$.

10. The electrophotographic photoreceptor according to claim 8, wherein in formula (1) and formula (2), $R^{11}$ is the same as $R^{21}$, $R^{12}$ is the same as $R^{22}$, $R^{13}$ is the same as $R^{23}$, $R^{14}$ is the same as $R^{24}$, $R^{15}$ is the same as $R^{25}$, $R^{16}$ is the same as $R^{26}$, $R^{17}$ is the same as $R^{27}$ and $R^{18}$ is the same as $R^{28}$.

11. The electrophotographic photoreceptor according to claim 1, wherein the first perinone compound and the second perinone compound are trans-cis isomers respectively.

12. The electrophotographic photoreceptor according to claim 1, wherein:

the first perinone compound is represented by the following formula 1-1 and the second perinone compound is represented by the following formula 2-1, the first perinone compound is represented by the following formula 1-2 and the second perinone compound is represented by the following formula 2-2, the first perinone compound is represented by the following formula 1-3 and the second perinone compound is represented by the following formula 2-3, the first perinone compound is represented by the following formula 1-4 and the second perinone compound is represented by the following formula 2-4, the first perinone compound is represented by the following formula 1-5 and the second perinone compound is represented by the following formula 2-5, the first perinone compound is represented by the following formula 1-6 and the second perinone compound is represented by the following formula 2-6, the first perinone compound is represented by the following formula 1-7 and the second perinone compound is represented by the following formula 2-7, the first perinone compound is represented by the following formula 1-8 and the second perinone compound is represented by the following formula 2-8, the first perinone compound is represented by the following formula 1-9 and the second perinone compound is represented by the following formula 2-9, the first perinone compound is represented by the following formula 1-10 and the second perinone compound is represented by the following formula 2-10, the first perinone compound is represented by the following formula 1-11 and the second perinone compound is represented by the following formula 2-11, the first perinone compound is represented by the following formula 1-12 and the second perinone compound is represented by the following formula 2-12, the first perinone compound is represented by the following formula 1-13 and the second perinone compound is represented by the following formula 2-13, the first perinone compound is represented by the following formula 1-4 and the second perinone compound is represented by the following formula 2-14, the first perinone compound is represented by the following formula 1-15 and the second perinone compound is represented by the following formula 2-15, the first perinone compound is represented by the following formula 1-16 and the second perinone compound is represented by the following formula 2-16, the first perinone compound is represented by the following formula 1-17 and the second perinone compound is represented by the following formula 2-17, or the first perinone compound is represented by the following formula 1-18 and the second perinone compound is represented by the following formula 2-18, wherein, in the formula 1-14 to 1-17 and the formula 2-14 to 2-17, Ph is a phenyl group:

1-1

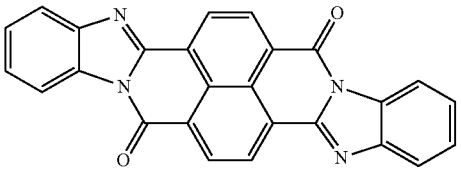

1-2

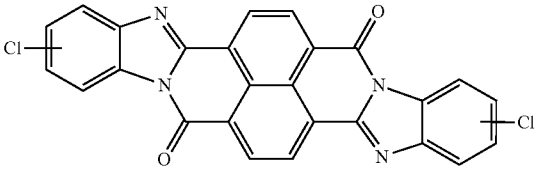

1-3

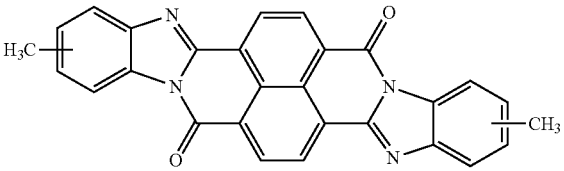

1-4

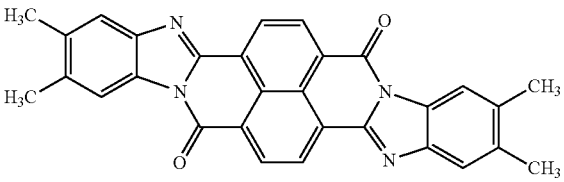

1-5

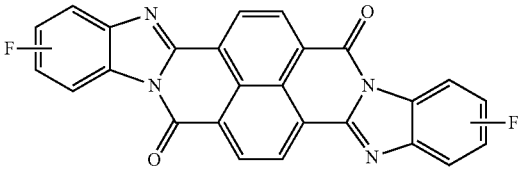

1-6

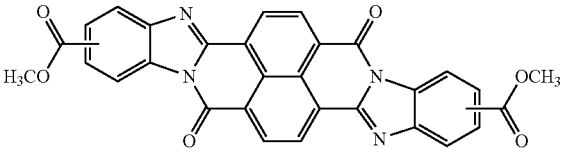

-continued 1-7

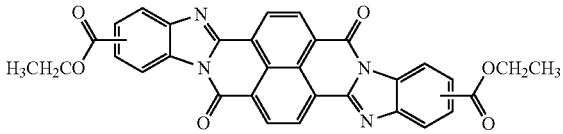

1-8

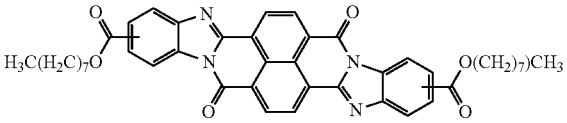

1-9

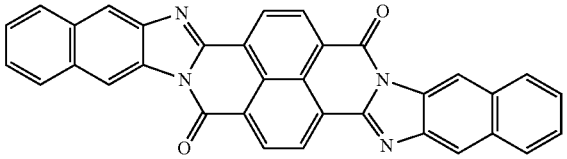

1-10

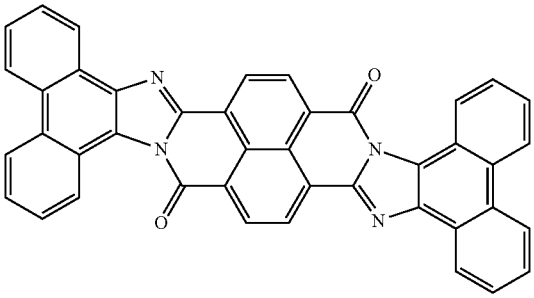

1-11

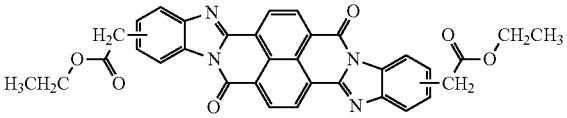

1-12

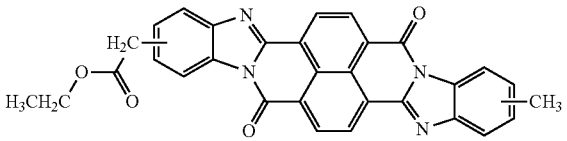

1-13

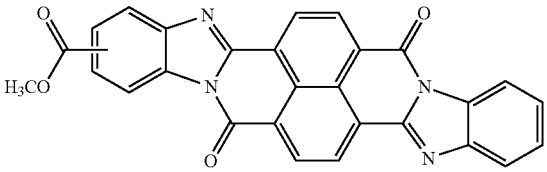

1-14

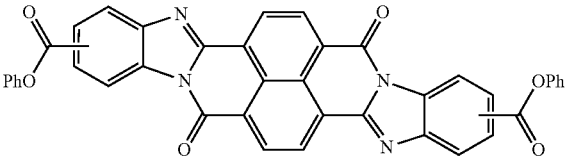

-continued
1-15
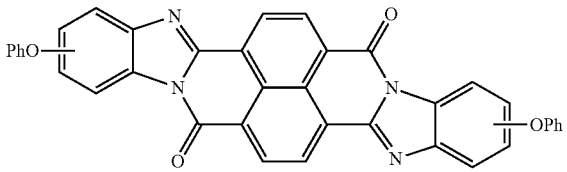
1-16
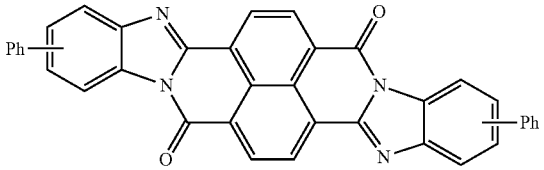
1-17
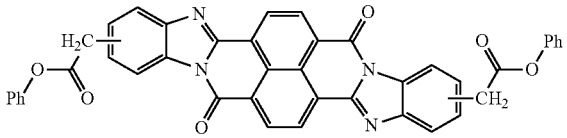
1-18
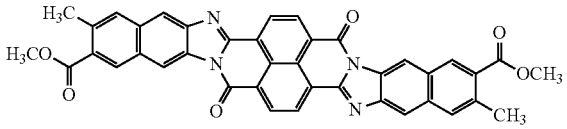
2-1
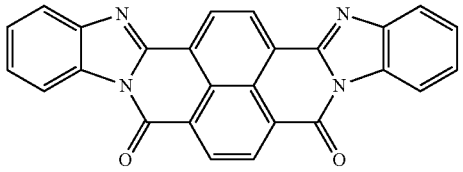
2-2
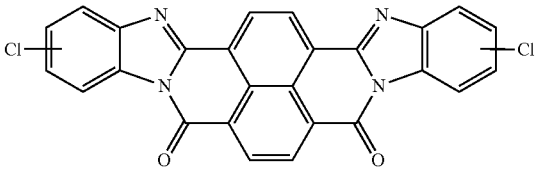
2-3
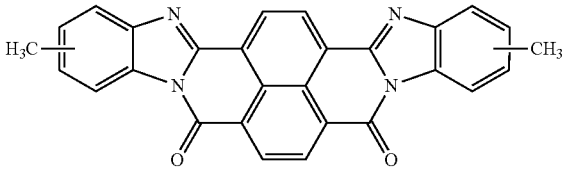
2-4
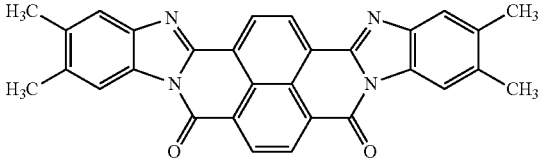
-continued
2-5
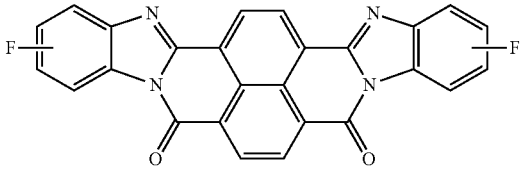
2-6
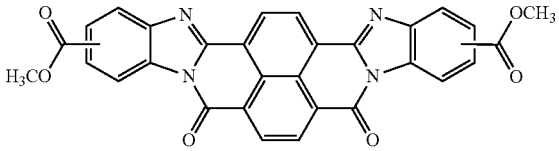
2-7
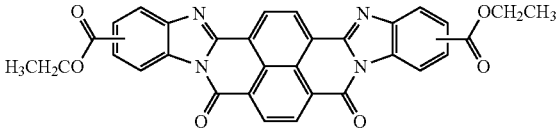
2-8
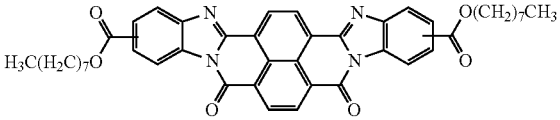
2-9
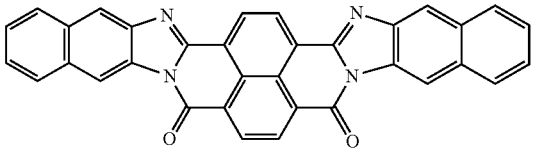
2-10
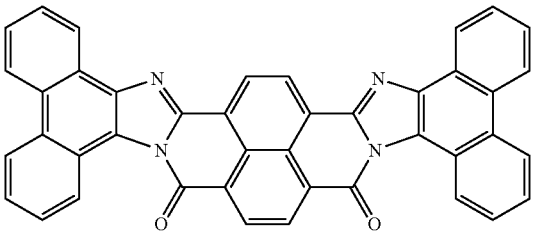
2-11
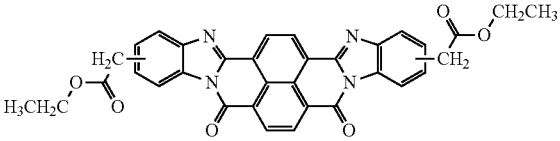
2-12
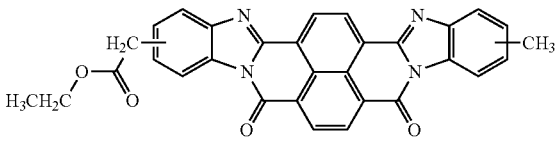

-continued
2-13
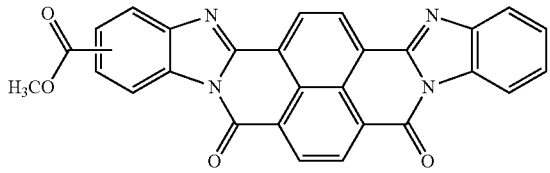
2-14
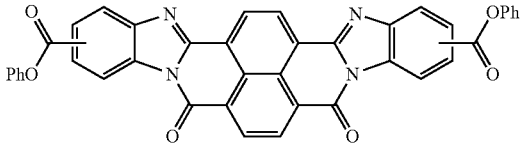
2-15
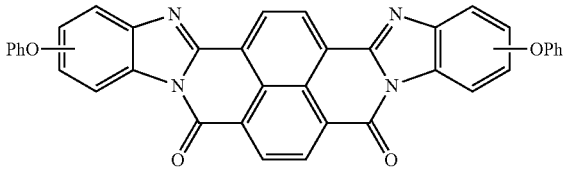
-continued
2-16
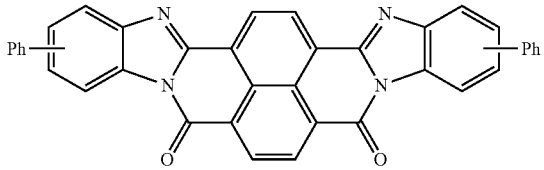
2-17
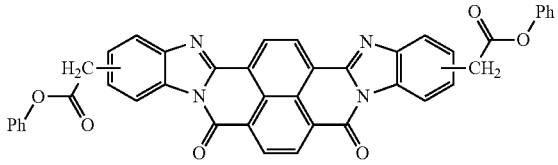
2-18
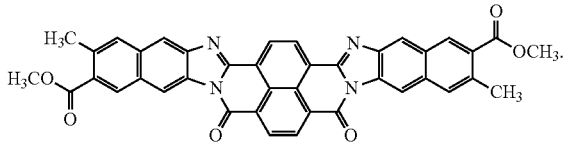
13. The electrophotographic photoreceptor according to claim 1, wherein a volume resistivity of the undercoat layer is $1\times10^{10}$ Ωcm or more and $1\times10^{12}$ Ωcm or less.
* * * * *